US008515332B2

(12) United States Patent
Matsuno

(10) Patent No.: US 8,515,332 B2
(45) Date of Patent: Aug. 20, 2013

(54) IMAGE FORMING APPARATUS HAVING FLAPPER

(75) Inventor: Takuji Matsuno, Ichinomiya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 930 days.

(21) Appl. No.: 12/413,967

(22) Filed: Mar. 30, 2009

(65) Prior Publication Data

US 2009/0297243 A1 Dec. 3, 2009

(30) Foreign Application Priority Data

May 29, 2008 (JP) ..... 2008-141412
May 29, 2008 (JP) ..... 2008-141415

(51) Int. Cl.
*G03G 15/00* (2006.01)
*B65H 31/00* (2006.01)

(52) U.S. Cl.
USPC ..... 399/406; 399/401; 271/209

(58) Field of Classification Search
USPC ..... 399/406, 401, 320, 322; 271/209, 271/161, 188, 301
See application file for complete search history.

(56) References Cited

U.S. PATENT DOCUMENTS 5,685,542 A * 11/1997 Weis ..... 473/459
5,788,229 A 8/1998 Asami et al.
7,298,981 B2 * 11/2007 Oohara et al. ..... 399/45

FOREIGN PATENT DOCUMENTS

JP 6-115790 4/1994
JP H06-202506 7/1994
JP 6-239001 8/1994
JP 7-61677 3/1995
JP 8-67392 3/1996
JP 2001-58751 3/2001
JP 2001-122498 5/2001
JP 2002-104694 4/2002
JP 2005-200167 7/2005
JP 2006-082948 3/2006
JP 2007-191294 8/2007
JP 2008-63081 3/2008

OTHER PUBLICATIONS

Japanese Official Action dated May 25, 2010, together with English-language translation.

* cited by examiner

*Primary Examiner* — Judy Nguyen
*Assistant Examiner* — Justin Olamit
(74) *Attorney, Agent, or Firm* — Scully, Scott, Murphy & Presser P.C.

(57) ABSTRACT

In an image forming device, a fixing unit thermally fixes a development image transferred onto a first surface of a recording medium, the recording medium having a second surface opposite to the first surface. The conveying wall defines a conveying path, along which the recording medium is conveyed from the fixing unit in a conveying direction, the recording medium being conveyed along the conveying path with the first surface of the recording medium confronting the conveying wall, the recording medium having a pair of lateral parts in a direction orthogonal to the conveying direction, the recording medium being curled at the pair of lateral parts to bring the first surface to face outwardly and the second surface to face inwardly. The abutting member is provided in confrontation with the conveying wall, with the conveying path being defined between the conveying wall and the abutting member, the recording medium being conveyed along the conveying path between the conveying wall and the abutting member with the second surface confronting the abutting member, the abutting member being urged so as to be capable of being in abutment contact with the lateral parts of the recording medium to eliminate the curling of the recording medium.

11 Claims, 18 Drawing Sheets

160 (2)

IMAGE FORMING APPARATUS HAVING FLAPPER

CROSS REFERENCE TO RELATED APPLICATION

This application claims priority from Japanese Patent Application Nos. 2008-141415 and 2008-141412 both of which were filed on May 29, 2008. The entire content of each of these priority applications is incorporated herein by reference.

TECHNICAL FIELD

The present invention relates to an image forming apparatus such as a laser printer.

BACKGROUND

Japanese Patent Application Laid-Open Publication No. 2002-104694 (Patent Document 1), for example, discloses a laser printer, which is an image forming apparatus of electronic photography type. The laser printer includes a fixing unit. The fixing unit has a heating roller and a pressing roller. The heating roller incorporates a halogen lamp that generates heat. The pressing roller presses the heating roller. More precisely, the pressing roller can press a paper sheet onto the heating roller when the paper sheet, which has a transferred toner image, passes through the nip between the heating roller and the pressing roller. When the pressing roller presses the paper sheet to the heating roller, the toner image is fixed on the sheet because of the heat applied to the sheet from the heating roller.

The paper sheet having the toner image thus fixed is conveyed forward and finally discharged onto a discharged-sheet tray trough a sheet discharge path. If a plurality of paper sheets are discharged, they are laid, one on another, on the discharged-sheet tray in the order they have been discharged.

In the laser printer described in Patent Document 1, a toner image is thermally fixed on the paper sheet. Therefore, the sheet may curl after the thermal fixing of the image.

SUMMARY

The curling of sheet is classified into two types, i.e., forward curling and cylindrical curling. Forward curling occurs when the sheet gradually bends toward its downstream part in the sheet conveying direction so that either one of the obverse side or the reverse side will face inwardly and so that the other one of the obverse side or the reverse side will face outwardly. Cylindrical curling gradually occurs when the sheet bends at both of a pair of lateral parts, which are spaced apart from each other in the direction (i.e., transverse direction) orthogonal to the sheet conveying direction, so that either one of the obverse side or the reverse side will face inwardly and so that the other one of the obverse side or the reverse side will face outwardly. If the cylindrical curling is prominent, the sheet will be shaped like a cylinder having an axis that is parallel to the sheet conveying direction.

If undergone the forward curling, the paper sheet is scarcely curled at the upstream part in the sheet conveying direction at least. The upstream part of the sheet therefore extends along the upper surface of the discharged-sheet tray when the sheet is discharged onto the discharged-sheet tray. Hence, subsequent sheets can be orderly stack on the forwardly curled sheet, not abutting on the upstream part of the curled sheet, even if discharged from the upstream side onto the forwardly curled sheet.

On the other hand, any cylindrically curled sheet has both lateral parts curved, all along the sheet conveying direction. So, when the cylindrically curled sheet is discharged onto the discharged-sheet tray, the lateral parts of the upstream part do not extend along the upper surface of the discharged-sheet tray. Consequently, the next sheet discharged from the upstream side onto the discharged-sheet tray may likely abut on the upstream part of the cylindrically curled sheet. If the next sheet abuts on the upstream part of the cylindrically curled sheet, the next sheet can hardly be orderly stack on the cylindrically curled sheet.

In view of the foregoing, an object of the present invention is to provide an image forming apparatus in which a recording medium can be prevented from being cylindrically curled and the recording medium can therefore be stack orderly one on another on the discharged-sheet tray.

In order to attain the above and other objects, the invention provides an image forming device, including: a fixing unit; a discharging unit; a reception unit; a conveying wall; and an abutting member. The fixing unit thermally fixes a development image transferred onto a first surface of a recording medium, the recording medium having a second surface opposite to the first surface. The discharging unit discharges the recording medium onto which the development image has been thermally fixed. The reception unit receives the recording medium discharged by the discharging unit. The conveying wall defines a conveying path, along which the recording medium is conveyed from the fixing unit toward the discharging unit in a conveying direction, the recording medium being conveyed along the conveying path with the first surface of the recording medium confronting the conveying wall, the recording medium having a pair of lateral parts in a direction orthogonal to the conveying direction, the recording medium being curled at the pair of lateral parts to bring the first surface to face outwardly and the second surface to face inwardly. The abutting member is provided in confrontation with the conveying wall, with the conveying path being defined between the conveying wall and the abutting member, the recording medium being conveyed along the conveying path between the conveying wall and the abutting member with the second surface confronting the abutting member, the abutting member being urged so as to be capable of being in abutment contact with the lateral parts of the recording medium to eliminate the curling of the recording medium. The abutting member has a concave portion that opposes the conveying wall, the concave portion having a pair of lateral parts and a central part arranged in a direction orthogonal to the conveying direction, the concave portion gradually receding in a direction away from the conveying wall from the pair of lateral parts toward the central part in the direction orthogonal to the conveying direction.

According to another aspect, the invention provides an image forming device, including: a fixing unit; a discharging unit; a reception unit; a conveying wall; and an abutting member. The fixing unit thermally fixes a development image transferred onto a first surface of a recording medium, the recording medium having a second surface opposite to the first surface. The discharging unit discharges the recording medium onto which the development image has been thermally fixed. The reception unit receives the recording medium discharged by the discharging unit. The conveying wall defines a conveying path, along which the recording medium is conveyed from the fixing unit toward the discharging unit in a conveying direction, the recording medium being conveyed along the conveying path with the first surface of the recording medium confronting the conveying wall, the recording medium having a pair of lateral parts in a direction orthogonal to the conveying direction, the recording medium being curled at the pair of lateral parts to bring the first surface to face outwardly and the second surface to face inwardly. The abutting member is provided in confrontation with the conveying wall, with the conveying path being defined between the conveying wall and the abutting member, the recording medium being conveyed along the conveying path between the conveying wall and the abutting member with the second surface confronting the abutting member, the abutting member being located at a position so as to be capable of being in abutment contact with the lateral parts of the recording medium to eliminate the curling of the recording medium, the abutting member being configured so as to be capable of applying the lateral parts of the recording medium with a load whose amount is changeable in accordance with a degree by which the lateral parts of the recording medium are curled.

BRIEF DESCRIPTION OF THE DRAWINGS

The particular features and advantages of the invention as well as other objects will become apparent from the following description taken in connection with the accompanying drawings, in which:

FIG. 5(*b*) illustrates a forward curling;

FIG. 6(*b*) is a perspective view showing a forwardly curled sheet discharged on the discharge tray, seen from the front left side of the printer;

FIG. 7(*b*) is a side view showing the forwardly curled sheet discharged on the discharge tray, seen from the left side of the printer;

DETAILED DESCRIPTION

Figure 1:
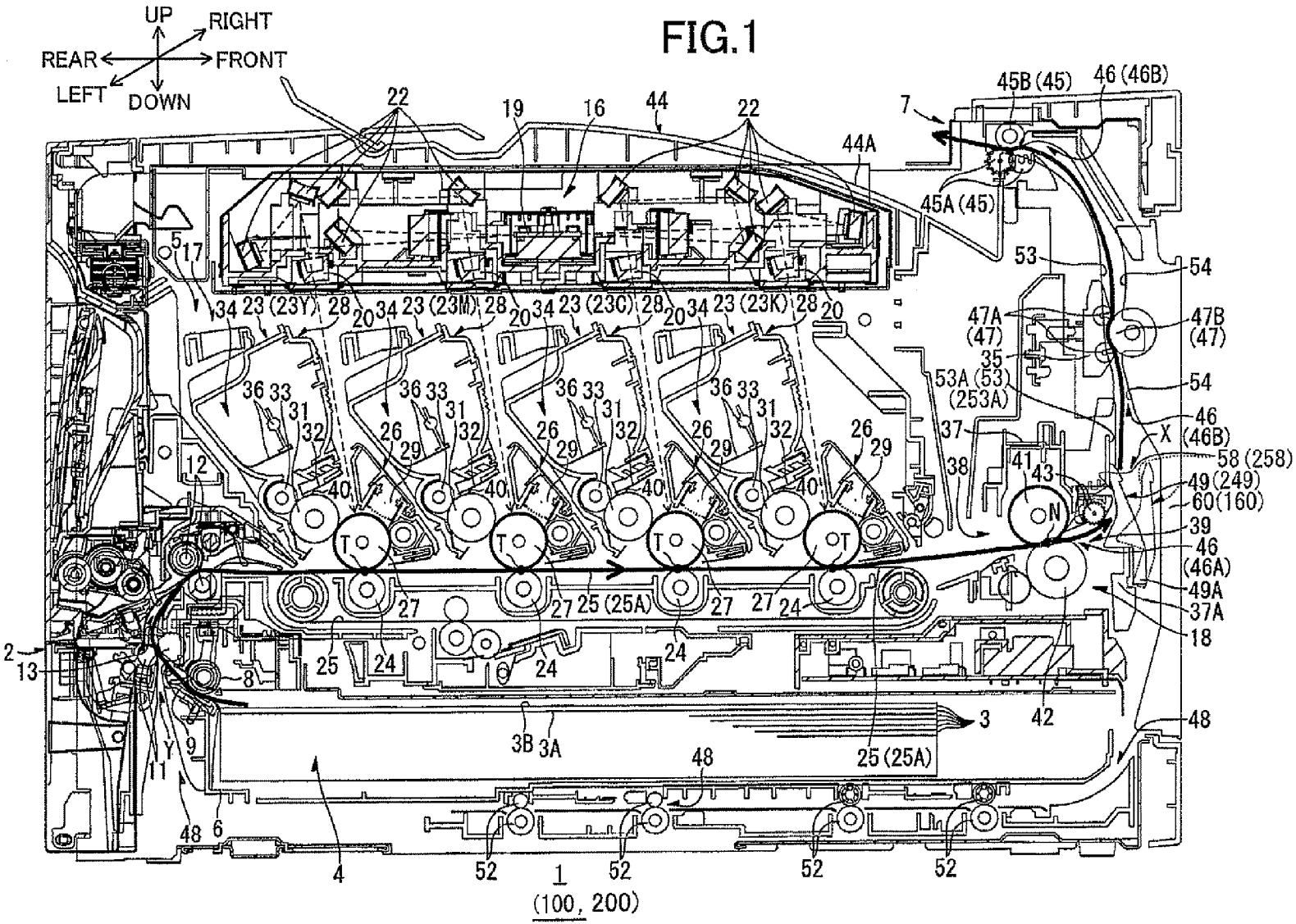
FIG. 1 is a side sectional view of a laser printer according to a first embodiment of the present invention.

An image forming apparatus according to embodiments of the present invention will be described while referring to the accompanying drawings wherein like parts and components are designated by the same reference numerals to avoid duplicating description.

First Embodiment

A laser printer 1, which is an image forming apparatus according to a first embodiment of the present invention, will be described with reference to FIGS. 1-10.

The terms "upward", "downward", "upper", "lower", "above", "below", "beneath", "right", "left", "front", "rear" and the like will be used throughout the description assuming that the later printer 1 is disposed in an orientation in which it is intended to be used. In use, the later printer 1 is disposed as shown in FIG. 1.

The "left-right direction" is identical to the widthwise direction of the printer 1. The "left-right direction" and the "front-back direction" exist in a horizontal plane.

First, the overall configuration of the laser printer 1 will be described with reference to FIGS. 1 to 4.

FIG. 1 shows the configuration of the laser printer 1 seen from the left side of the laser printer 1 in the widthwise direction thereof.

The laser printer 1 is a color printer. The laser printer 1 has a main casing 2. The main casing 2 is a box, somewhat elongated in the front-back direction.

The laser printer 1 has a sheet feeding unit 4, an image forming unit 5 and a sheet discharge unit 7, all provided in the main casing 2. The sheet feeding unit 4 is configured to feed paper sheets 3, i.e., an example of recording media, to the image forming unit 5. The image forming unit 5 is configured to form images on sheets 3 fed by the sheet feeding unit 4. The sheet discharge unit 7 is configured to discharge sheets 3, each having an image formed.

1. Sheet Feeding Unit

The sheet feeding unit 4 includes a sheet feeding tray 6, a sheet feeding roller 8, a sheet feeding pad 9, a pair of conveying rollers 11, and a pair of registering rollers 12. The tray 6, roller 8, pad 9, rollers 11 and rollers 12 are arranged in the order mentioned, from upstream in the direction (hereinafter called "conveying direction," see the solid-line arrow) in which a sheet 3 is conveyed in the image forming process.

The sheet feeding tray 6 is arranged extending along the lower wall (bottom wall) of the main casing 2. A plurality of sheets 3 are stack on the sheet feeding tray 6. Each sheet 3 has an obverse side (first side 3A) and a reverse side (second side 3B). The lower surface and upper surface of any sheet 3 stack on the sheet feeding tray 6 shall be hereinafter referred to as first side 3A and second side 3B, respectively.

The sheet feeding roller 8 and the sheet feeding pad 9 are arranged above the rear edge of the sheet feeding tray 6 and are opposed to each other.

The conveying rollers 11 are arranged obliquely above and behind the sheet feeding roller 8.

The registering rollers 12 are arranged above the conveying rollers 11 and are opposed to each other.

The sheet feeding unit 4 further includes a sheet feeding path 13.

The sheet feeding path 13 is a sheet conveying path that extends from the upper edge of the rear end of the sheet feeding tray 6 and passes through the gap between the sheet feeding roller 8 and the sheet feeding pad 9, the nip between the pair of conveying rollers 11 and the nip between the pair of registering rollers 12. The sheet feeding path 13 first extends rearwards from the upper edge of the rear end of the sheet feeding tray 6, then gently turns back toward the front, rising slantwise and thus making a U-turn, and finally extends to a point in front of the registering rollers 12, more precisely to the upper part 25A of a conveying belt 25 which will be described later.

To form an image on a sheet, the uppermost one of the sheets 3 stack on the sheet feeding tray 6 is conveyed through the sheet feeding path 13 to the registering rollers 12. In the sheet feeding path 13, only one sheet 3 can pass at a time through the nip between the sheet feeding roller 8 and the sheet feeding pad 9, and paper dust, if any, is removed from the sheet 3 at the nip between the conveying rollers 11.

The registering rollers 12 first register the sheet 3 and then convey the sheet 3 to the image forming unit 5 (more precisely, onto the above-mentioned upper part 25A of the conveying belt 25).

While passing through the sheet feeding path 13 that is U-turned, the sheet 3 is turned upside down. That is, the first side 3A and the second side 3B are switched in orientation. More specifically, the first side 3A that turned down while the sheet 3 remained stack on the sheet feeding tray 6 is turned up when the sheet 3 reaches the registering rollers 12. By contrast, the second side 3B that turned up while the sheet 3 remained stack on the sheet feeding tray 6 is turned down when the sheet 3 reaches the registering rollers 12.

2. Image Forming Unit

The image forming unit 5 includes a scanner unit 16, a process unit 17, and a fixing unit 18.

(1) Scanner Unit

The scanner unit 16 is provided on the top of the main casing 2. The scanner unit 16 includes a laser emitting part (not shown), a polygon mirror 19, a plurality of lenses 20, and a plurality of reflectors 22. The polygon mirror 19 rotates while the scanner unit 16 is operating.

To form an image on a sheet 3, the laser emitting part (not shown) emits a laser beam representing specific image data. The laser beam is reflected by the polygon mirror 19 as indicated by a broken-line arrow, is reflected by the reflectors 22, then passes through the lenses 20, and is applied to the surfaces (i.e., circumferential surfaces) of four photosensitive drums 27 of the process unit 17. (The drums 27 will be described later.)

(2) Process Unit

The process unit 17 is located between the scanner unit 16 and the sheet feeding tray 6, as viewed in the up down direction.

The process unit 17 includes four cartridges 23, four transfer rollers 24, and a conveying belt 25. The cartridges 23 contain four types of toner, respectively, each type of toner (which will be described later) having been prepared to form an image in a specific color.

(2-1) Cartridges

The four cartridges 23 are juxtaposed, each removably secured in the main casing 2.

The four cartridges 23 are cartridge 23M (magenta), cartridge 23K (black), cartridge 23C (cyan) and cartridge 23Y (yellow), each containing toner of a specific color. More precisely, the cartridge 23M contains magenta toner, the cartridge 23K contains black toner, the cartridge 23C contains cyan toner, and the cartridge 23Y contains yellow toner.

Each of the cartridges 23M, 23K, 23C and 23Y includes a drum part 26 and a developing part 28. The developing part 28 is coupled to the top of the drum part 26. The drum part 26 and the developing part 28 may be designed to be separated from each other.

The drum part 26 incorporates a photosensitive drum 27, a scorotron-type charging device 29, and some other components. The photosensitive drum 27 has an axis extending in the widthwise direction of the printer 1 and can rotate around the axis. The circumferential surface of the drum 27 is exposed at the lower part of the cartridge 23. The charging device 29 is arranged, spaced apart from the surface of the drum 27 and opposed, from above, to the circumferential surface of the drum 27.

The developing part 28 incorporates a developing roller 31, a layer-thickness regulating blade 32, a toner-conveying roller 33, a toner container 34, and some other components.

The developing roller 31 and the toner-conveying roller 33 have an axis each, which extends in the widthwise direction of the printer 1. The developing roller 31 and the toner-conveying roller 33 can rotate around the axis. The developing roller 31 is pressed onto the drum 27, from behind the drum 27 in a direction oblique to the drum 27. The toner-conveying roller 33 is pressed onto the developing roller 31, from behind the roller 31 in a direction oblique to the roller 31.

The layer-thickness regulating blade 32 is a thin leaf spring that extends toward the developing roller 31. A rubber pusher 40 is attached to the distal end of the layer-thickness regulating blade 32. The rubber pusher 40 pushes the surface (i.e., outer circumferential surface) of the developing roller 31, by virtue of the elastic force of the blade 32.

The toner container 34 is arranged above the toner-conveying roller 33. The toner container 34 opens to the toner-conveying roller 33.

The toner container 34 contains non-magnetic, one-component toner that can be charged electrically positive. The color of the toner contained in the toner container 34 is specific to each cartridge 23. More specifically, the toner container 34 of the cartridge 23K contains black toner, the toner container 34 of the cartridge 23C contains cyan toner, the toner container 34 of the cartridge 23M contains magenta toner, and the toner container 34 of the cartridge 23Y contains yellow toner.

An agitator 36 is provided in the toner container 34. The agitator 36 can rotate to agitate the toner in the toner container 34.

(2-2) Transfer Rollers and Conveying Belt

The four transfer rollers 24 are arranged, with their axes extending in the widthwise direction of the printer 1, and can rotate around their axes. The transfer rollers 24 are spaced apart from one another, in the front-back direction.

The conveying belt 25 is an endless belt. As viewed in the widthwise direction of the printer 1, the conveying belt 25 looks like a flat loop. The four transfer rollers 24 are arranged in the loop of the conveying belt 25. To form an image on a sheet 3, the conveying belt 25 is driven clockwise, as viewed from the left side of the main casing 2. As the belt 25 is so driven, the upper part 25A of the belt 25, which lies above the transfer rollers 24, moves from the back of the casing 2 toward the front thereof.

Each transfer roller 24 is opposed, from below, to the associated photosensitive drum 27 (more precisely, to the lower part of the surface, which is exposed from the cartridge 23). The upper part 25A of the conveying belt 25 is interposed between each transfer roller 24 and the drum 27 associated with the transfer roller 24. The position where the upper part 25A of the belt 25 contacts the photosensitive drum 27 is an image-transfer position T. There are four image-transfer positions T, or as many transfer positions as the photosensitive drums 27 (i.e., as many as the cartridges 23). The image-transfer positions T are arranged in the front-back direction of the main casing 2.

(2-3) Operation of Process Unit During Image Forming

To form an image on a sheet 3, in each cartridge 23, the rotating agitator 36 agitates the toner in the toner container 34. The toner thus agitated falls onto the toner-conveying roller 33. As the toner-conveying roller 33 and the developing roller 31 rotate, the toner enters the gap between the developing roller 31 and the rubber pusher 40, forming a thin toner layer. The toner layer is held on the circumferential surface of the photosensitive drum 27.

The circumferential surface of the photosensitive drum 27 is charged electrically positive by means of the charging device 29. Then, the circumferential surface of the drum 27 is scanned with the laser beam (indicated by a broken-line arrow in the drawing) emitted from the scanner unit 16. An electrostatic latent image represented by image data is thereby formed on the circumferential surface of the photosensitive drum 27.

As the photosensitive drum 27 and the developing roller 31 rotate, the toner is applied from the surface of the developing roller 31 to the electrostatic latent image formed on the circumferential surface of the photosensitive drum 27. As a result, an electrostatic latent image is developed (visualized), forming a toner image on the circumferential surface of the drum 27. The toner image thus formed has the color of the toner that is contained in the toner container 34.

After passing through the sheet feeding path 13, the sheet 3 is transferred from the registering rollers 12 to the upper part 25A of the transfer belt 25, with the first side 3A turned up (with the second side 3B turned down). Thus, the sheet 3 is transferred forward while laid on the transfer belt 25, with the first side 3A turned up. The sheet 3 then passes by the four image-transfer positions T, one after another. At the four respective image-transfer positions T, four toner images of different colors are transferred to the sheet 3 from the photosensitive drums 27 of the cartridges 23, by virtue of the transfer biases applied to the respective transfer rollers 24. That is, the four toner images of different colors are sequentially printed, one on another, on the sheet 3. At this point, the sheet 3 remains positioned with the first side 3A turned up. The toner images are therefore transferred to the first side 3A of the sheet 3.

The sheet 3 now having a toner image transferred is conveyed forward, with the first side 3A turned up, while being laid on the upper part 25A of the transfer belt 25.

(3) Fixing Unit

The fixing unit 18 is arranged in front of the process unit 17. The fixing unit 18 includes a fixing casing 37, a heating roller 41, a pressing roller 42, and a plurality of rollers 43. The fixing unit 18 further includes a flapper 49. The flapper 49 will be described later in detail.

Figure 3:
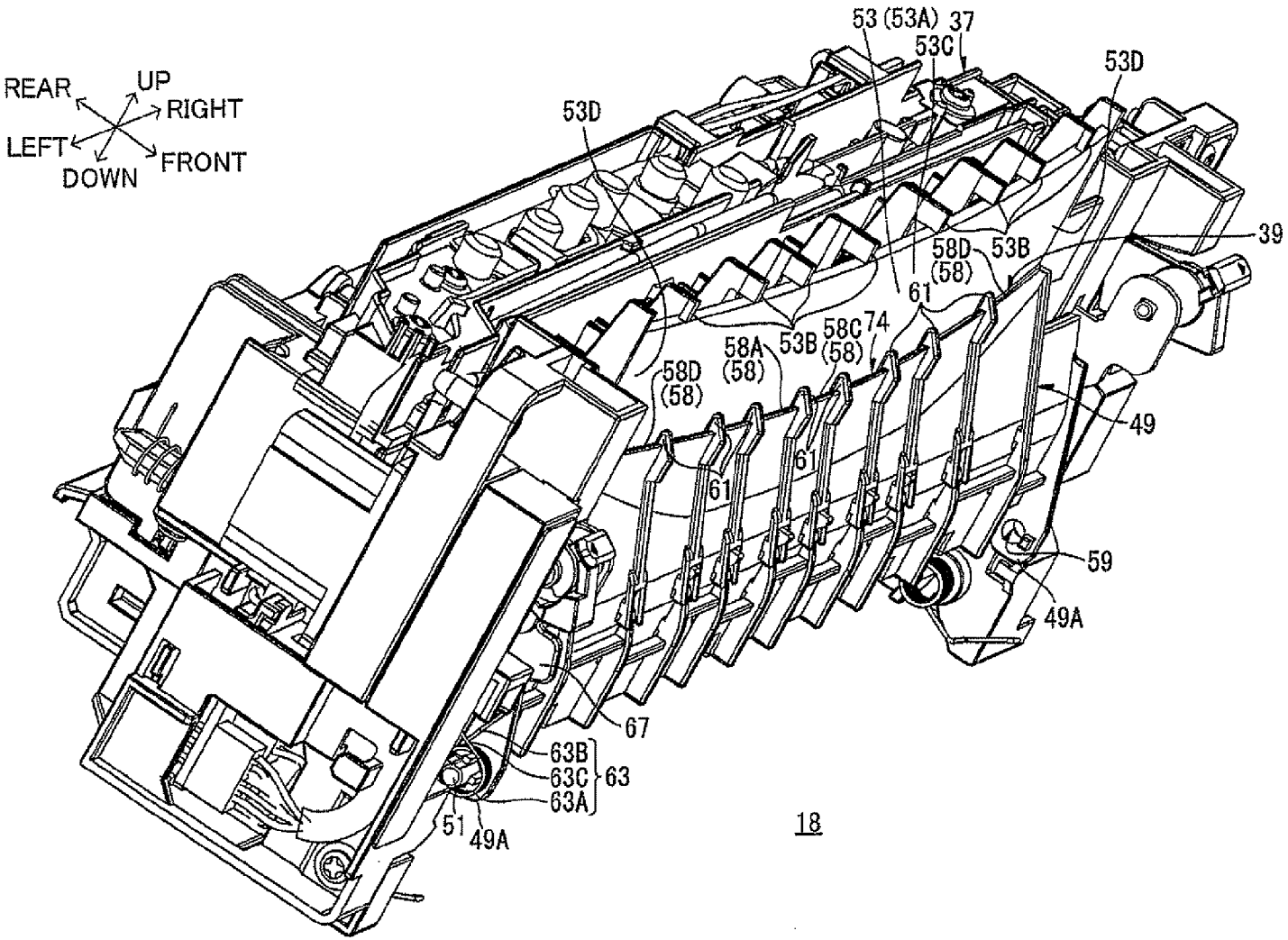
FIG. 3 is a perspective view of a fixing unit seen from the front left side of the printer, a flapper in the fixing unit being located at a second position.
Figure 4:
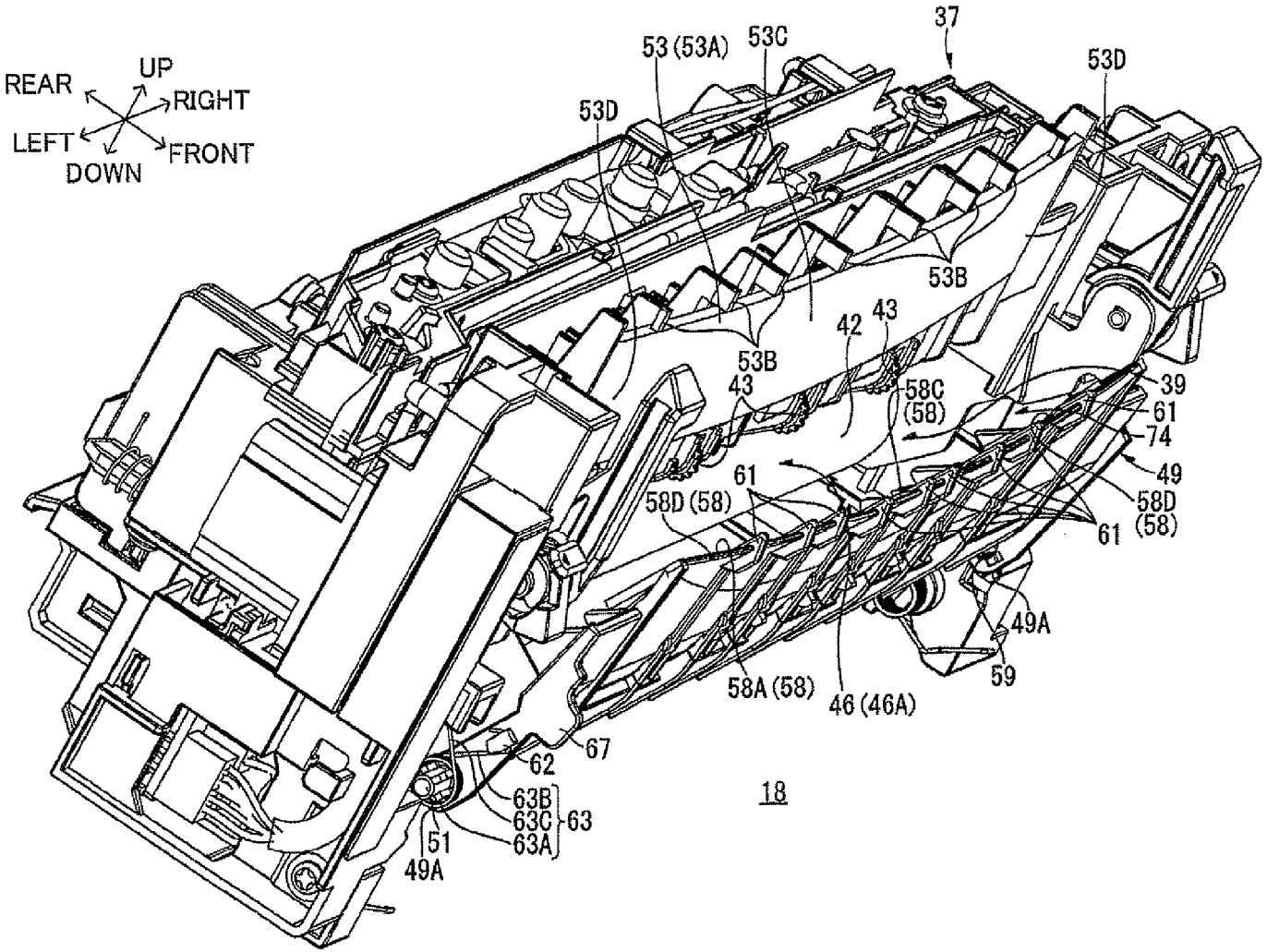
FIG. 4 is another perspective view of the fixing unit seen from the front left side of the printer, the flapper being located at a first position.

The fixing casing 37 is a hollow box elongated in the widthwise direction of the printer 1 (see FIG. 3 and FIG. 4). The fixing casing 37 has an inlet port 38 and an outlet port 39. The inlet port 38 is made in the back, and the outlet port 39 is made in the front. (The outlet port 39 is shown in FIG. 4.) Both the inlet port 38 and the outlet port 39 are large enough to allow the passage of sheets 3 and communicate with the interior of the fixing casing 37.

The heating roller 41 and the pressing roller 42 are arranged in the fixing casing 37, each having an axis extending in the widthwise direction of the printer 1, and can rotate around their respective axes.

The outer circumferential surface of the heating roller 41 is covered with, for example, fluororesin. The heating roller 41 contains a halogen lamp (not shown) that can heat the outer circumferential surface of the heating roller 41.

The outer circumferential surface of the pressing roller 42 is covered with, for example, silicone rubber. The pressing roller 42 is pressed onto the heating roller 41 from below. The nip (hereinafter called "nip position N") between the heating roller 41 and the pressing roller 42 is located in front of the upper part 25A of the transfer belt 25. The inlet port 38 of the fixing casing 37 is positioned between the nip position N and the upper part 25A of the belt 25. The outlet port 39 of the fixing casing 37 is provided in front of the nip position N.

As shown in FIG. 4, the rollers 43 are shaped like a disc. To be more specific, the rollers 43 are shaped like a gear. Each roller 43 has depressions in, and projections on, the circumferential surface. The depressions and projections are alternately arranged. Each roller 43 has an axis extending in the widthwise direction of the printer 1 and can rotate around the axis at the upper part of the rim of the outlet port 39 of the fixing casing 37. The rollers 43 are arranged coaxial and spaced apart from one another in the widthwise direction of the printer 1.

As FIG. 1 shows, the sheet 3 resting on the upper part 25A of the conveying belt 25 and being conveyed forward, with toner images formed on the first side 3A, enters the fixing casing 37 through the inlet port 38 thereof. In the fixing casing 37, the sheet 3 passes through the nip (i.e., nip position N) between the heating roller 41 and the pressing roller 42. While passing through the nip position N, the sheet 3 is pressed onto the outer circumferential surface of the heating roller 41. The toner image transferred to the first side 3A of the sheet 3 is thermally fixed because the surface of the heating roller 41 is heated.

The sheet 3 is further conveyed forward, with the first side 3A turned up. More specifically, the sheet 3 is moved out of the fixing casing 37 through the outlet port 39 and conveyed to the sheet discharge unit 7, while being guided by the rollers 43.

Next will be described how the sheet curls with reference to FIGS. 5(*a*) and 5(*b*).

Figure 5A:
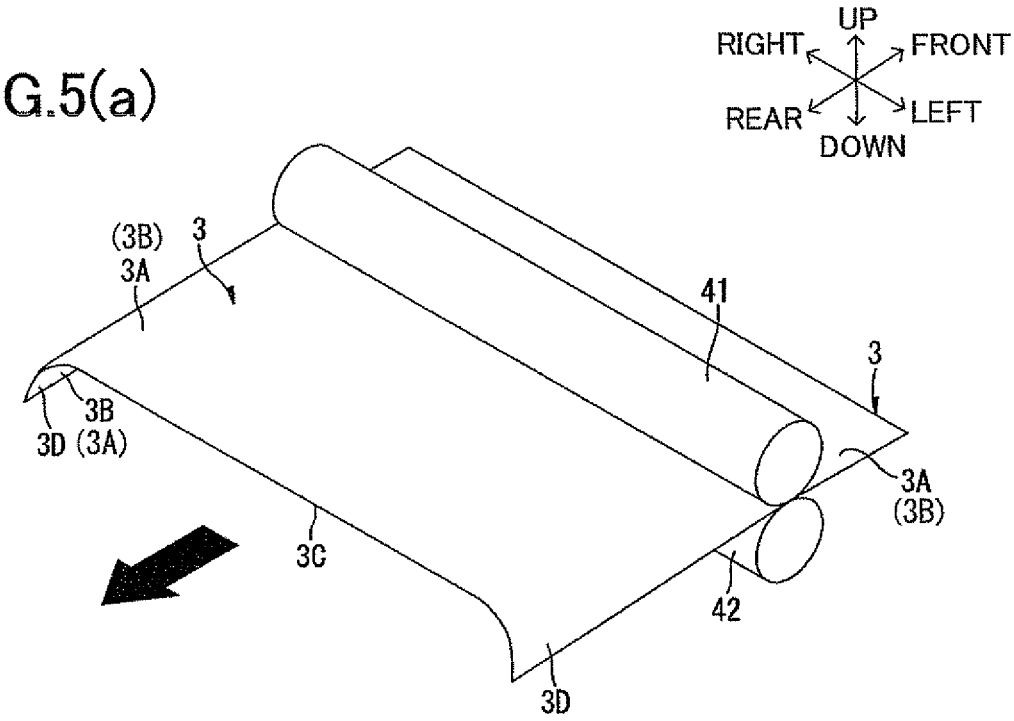
FIG. 5(*a*) illustrates a cylindrical curling.
Figure 5B:
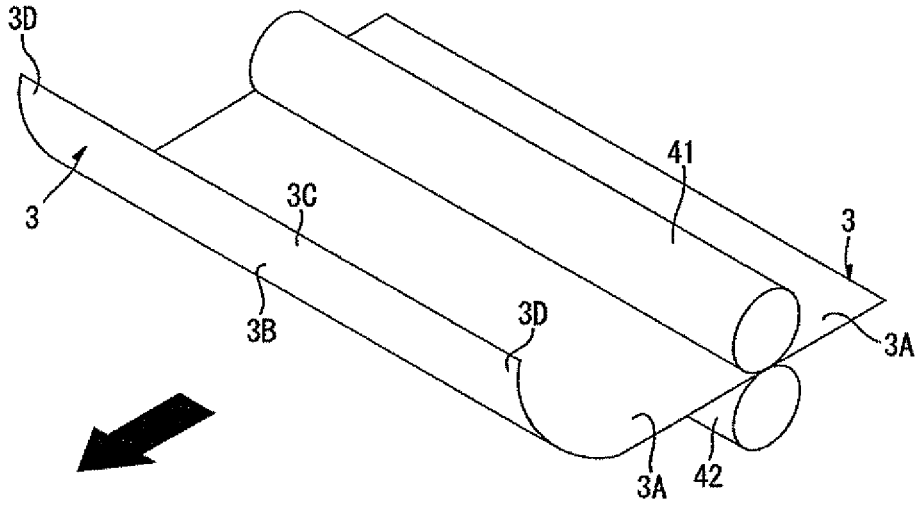

FIG. 5(*a*) is a diagram explaining how a sheet undergoes cylindrical curling. FIG. 5(*b*) is a diagram explaining how a sheet undergoes forward curling.

As the sheet 3 is subjected to thermal fixing, the sheet 3 may be cylindrically curled, starting at the distal end (i.e., end downstream in the sheet conveying direction) that is first heated. Cylindrical curling occurs when, as shown in FIG. 5(*a*), the sheet 3 bends at both of a pair of lateral parts 3D, which are spaced apart from each other in the direction (i.e., transverse direction) orthogonal to the sheet conveying direction (indicated by an arrow), so that the side on which no toner images are formed (that is, second side 3B in this case) will face inwardly and so that the side on which a toner image is formed (that is, first side 3A in this case) will face outwardly.

The sheet 3 cylindrically curled looks like letter U as viewed in the sheet conveying direction. The cylindrical curling may result from an uneven temperature distribution along the heating roller 41, onto which the sheet 3 is pressed, which occurs in the widthwise direction of the printer 1. The cylindrical curling may result also from the shape change of the outer circumferential surface of the heating roller 41, which occurs in the widthwise direction of the printer 1.

On the other hand, the sheet 3 may undergo forward curling, besides the cylindrical curling. Forward curling occurs when, as shown in FIG. 5(*b*), the sheet 3 gradually bends toward the downstream part thereof in the sheet conveying direction (indicated by an arrow) so that either one of the first side 3A and the second side 3B will face inwardly and so that the other one of the first side 3A and the second side 3B will face outwardly. (In the case shown in FIG. 5(*b*), the sheet 3 bends so that the first side 3A will face inwardly and so that the second side 3B will face outwardly.)

3. Sheet Discharge Unit

As FIG. 1 shows, the sheet discharge unit 7 includes a sheet discharge tray 44, sheet discharge rollers 45, a sheet discharge path 46, and relay rollers 47.

The sheet discharge tray 44 is provided on the upper surface of the main casing 2. The tray 44 inclines, having a rear side located at a higher level than the front side. More specifically, the sheet discharge tray 44 (precisely, a mounting surface 44A for holding sheets 3 stack one on another) is smoothly convex upwards, from the front edge toward an intermediate position between the front edge and a rear edge.

Figure 2:
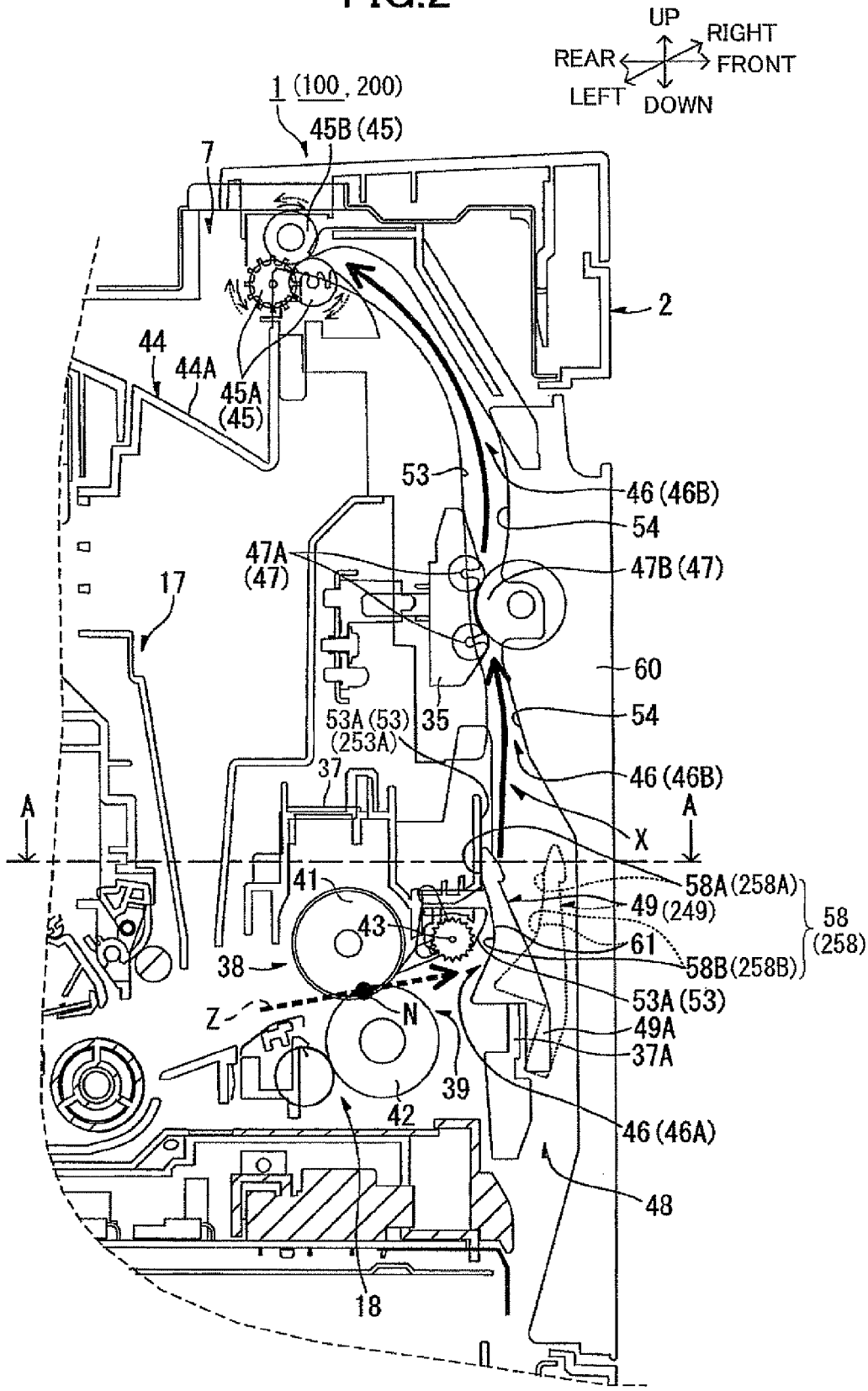
FIG. 2 is an enlarged view of an essential part in FIG. 1.

As shown in FIG. 2, three sheet discharge rollers 45, for example, are provided. Each sheet discharge roller 45 lies in front of the sheet discharge tray 44, has an axis extending in the widthwise direction of the printer 1 and can rotate around the axis. Of the three sheet feeding rollers 45, two rollers 45 (hereinafter called "first sheet discharge rollers 45A") are arranged in the front-back direction and opposed to each other. The remaining roller 45 (hereinafter called "second sheet discharge roller 45B") is pressed onto the first sheet discharge rollers 45A from above. Of the three sheet discharge rollers 45, the roller 45 (rear first sheet discharge roller 45A) closest to the sheet discharge tray 44 is shaped like a gear as viewed in the widthwise direction of the printer 1. This roller 45A has depressions in, and projections on, the circumferential surface, and the depressions and projections are alternately arranged.

Each sheet discharge roller 45 can rotate in the forward direction (see solid-line arrow) and in the reverse direction (see broken-line arrow). When the sheet discharge rollers 45 rotate, the two first sheet discharge rollers 45R rotate in one direction and the second sheet discharge roller 45B rotates in the opposite direction.

The sheet discharge path 46 extends from the nip position N of the fixing unit 18 to the sheet discharge rollers 45 (more correctly, the position where the two first sheet discharge rollers 45A contact the second sheet discharge roller 45B), at which position the sheet discharge path 46 reaches the front of the sheet discharge tray 44. That is, the sheet discharge path 46 first extends from the nip position N, then extends through the outlet port 39 of the fixing casing 37, and then gently U-turns upwards and backwards, and further extends to the position where the two first sheet discharge rollers 45A contact the second sheet discharge roller 45B. In other words, the sheet discharge path 46 is U-shaped, opening at the rear as viewed in the widthwise direction of the printer 1, and extends from the nip position N (located upstream in the sheet conveying direction) toward the sheet discharge rollers 45 (located downstream in the sheet conveying direction).

The U-shaped, sheet discharge path 46 is defined by two walls 53 and 54, which are provided in the main casing 2. One wall 53 (hereinafter called "inner wall 53") is located inner than the other wall 54 (hereinafter called "outer wall 54"). The inner wall 53 and the outer wall 54 are curved from the upstream side to the downstream side in the sheet conveying direction so as to be substantially U-shaped, each opening at the rear as viewed in the widthwise direction of the printer 1. The inner wall 53 is opposed to the outer wall 54 from behind and spaced apart from the outer wall 54 by a distance longer than the thickness of the sheet 3 (see FIG. 1). The space between the inner wall 53 and the outer wall 54 is the sheet discharge path 46.

An upper part of the front surface of the fixing casing 37 that is located above the outlet port 39 constitutes a part of the inner wall 53, and will be referred to as an "inner branching part 53A," hereinafter. A part of the outer wall 54 is constituted by the back surface of the front wall of the main casing 2. Further, that part of the main casing 2, which constitutes the outer wall 54, is a cover 60 that can freely open and close (see FIG. 1, too). The cover 60 can swing around the lower edge to open and close. When the cover 60 is rotated or inclined forwards, the interior of the main casing 2 can be accessed. Therefore, the maintenance of the components in the main casing 2 can be accomplished. If swung up backwards, the cover 50 will be closed.

The inner wall 53, per se. may not be curved at all. In this example, a plurality of ribs 53B project from the inner wall 53 toward the sheet discharge path 46 and are spaced apart from one another in the widthwise direction of the printer 1 (a part of the ribs 53B is shown in FIG. 4). The front surfaces of the ribs 53B are curved from the upstream side to the downstream side in the sheet conveying direction to provide the substantially U-shaped sheet discharge path 46 as shown in FIGS. 1 and 2. Similarly, the outer wall 54 may not be curved at all. In this example, a plurality of ribs 54A project from the outer wall 54 toward the sheet discharge path 46 and are spaced apart from one another in the widthwise direction of the printer 1 (see later described FIG. 11 and FIG. 12). The back surfaces of the ribs 54A are curved from the upstream side to the downstream side in the sheet conveying direction to provide the substantially U-shaped sheet discharge path 46.

Three relay rollers 47, for example, are provided. Each relay roller 47 has an axis that extends in the widthwise direction of the printer 1 and can rotate around the axis. The relay rollers 47 exist in almost the middle part of the sheet discharge path 46 and protrude into the sheet discharge path 46.

To be more specific, two relay rollers 47 (hereinafter called "first relay rollers 47A") protrude from the inner wall 53 into the sheet discharge path 46 and are spaced apart from each other by a prescribed distance in the up-down direction. A holder 35 projects from the inner wall 53 and supports the two first relay rollers 47A, allowing the rollers 47A to freely rotate. The holder 35 can move back and forth, coming from and into the sheet discharge path 46. The remaining relay roller 47 (hereinafter called "second relay roller 47B") is supported by the outer wall 54, can rotate freely and protrudes from the outer wall 54 into the sheet discharge path 46. The second relay roller 47B has a larger diameter than the first relay rollers 47A.

The holder 35 is biased to project into the sheet discharge path 46. The two first relay rollers 47A, which are supported by the holder 35, are therefore pressed onto the second relay roller 47B.

As shown in FIG. 1, the sheet 3 moving toward the sheet discharge unit 7 after a toner image has been thermally fixed in the image forming process is conveyed to the sheet discharge rollers 45 through the sheet discharge path 46. While the sheet 3 is passing through the sheet discharge path 46, the first side 3A and second side 3B of the sheet 3 face the inner wall 53 and the outer wall 54, respectively. The sheet 3 is conveyed (discharged) onto the sheet discharge tray 44 by the sheet discharge rollers 45 rotating in the forward direction of solid-line arrows (FIG. 2). The sheet 3 is conveyed from the front to rear of the main casing 2 and finally laid on the mounting surface 44A of the sheet discharge tray 44. If a plurality of sheets 3 are discharged, they are stack on the mounting surface 44A, one on another in the order they are discharged.

As described above, as the sheet 3 passes through the sheet discharge path 46 that is U-shaped, the sheet 3 is turned upside down. In other words, the first side 3A and second side 3B, which were turned up and down, respectively, when the sheet 3 was passing through the outlet port 39 of the fixing unit 18, are turned down and up, respectively, when the sheet 3 reaches the sheet discharge rollers 45. Hence, the second side 3B is the upper side of the sheet 3 when the sheet 3 is discharged onto the mounting surface 44A of the sheet discharge tray 44.

Next will be described, with reference to FIGS. 6(*a*)-7(*b*), how the sheet 3 that undergoes curling is discharged and mounted on the mounting surface 44A of the discharge tray 44.

As described above, the sheet 3 may undergo cylindrical curling because of the thermal fixing, bending to the second side 3B at both lateral parts 3D (see FIG. 5(*a*)). That is, the sheet 3 bends at both lateral parts 3D so that the second side 3B will face inwardly, and the first side 3A will face outwardly. Unless the cylindrical curling is eliminated, the sheet is being conveyed through the sheet discharge path 46, with its lateral parts 3D remaining curved toward the side of the outer wall 54. When the sheet 3 cylindrically curled is discharged onto the mounting surface 44A of the sheet discharge tray 44, the lateral parts 3D are bent upwards (see FIG. 6(*a*) and FIG. 7(*a*)).

On the other hand, now assume that the sheet 3 undergoes forward curling as shown in FIG. 5(*b*), bending gradually toward the downstream part to the first side 3A. That is, the sheet 3 bends gradually toward the downstream part so that the first side 3A will face inwardly, and the second side 3B will face outwardly. In this case, the sheet 3 will be eventually laid on the mounting surface 44A, extending properly along the mounting surface 44A that is convex upwards similarly to the forwardly curled sheet 3 (see FIG. 6(*a*)).

Figure 7A:
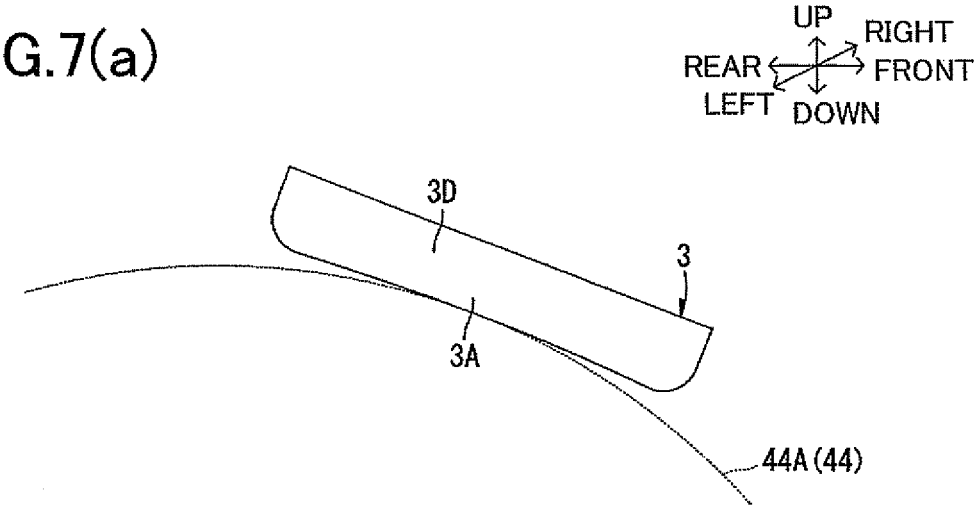
FIG. 7(*a*) is a side view showing the cylindrically curled sheet discharged on the discharge tray, seen from a left side of the printer.
Figure 7B:
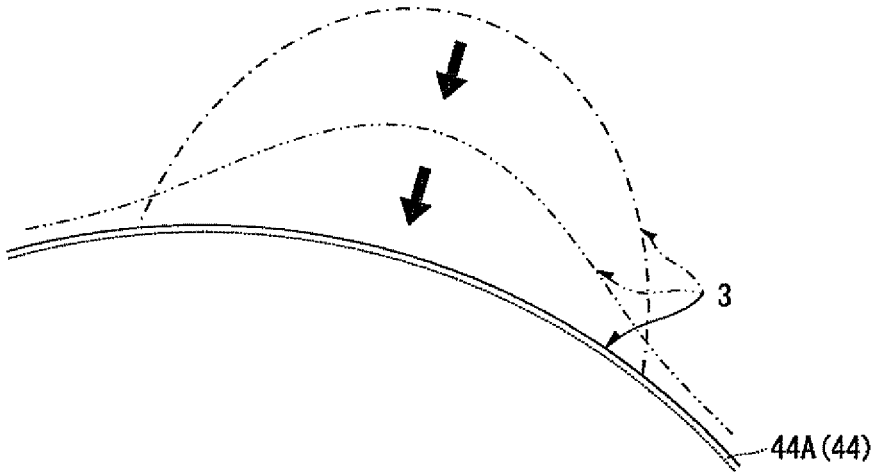

Even if the forwardly curled sheet 3 is greatly convex upwards as the one-dot, dashed line or two-dot, dashed line indicated in FIG. 7(*b*), the curled part of the sheet 3 will sag toward the mounting surface 44A of the sheet discharge tray 44 (as indicated by the arrows). The sheet 3 will therefore eventually extend properly along the mounting surface 44A as indicated by the solid line in FIG. 7(*b*).

As FIG. 1 shows, the sheet 3 passes through the nip between the two first relay rollers 47R and the second relay roller 47B, while conveyed in the sheet discharge path 46. At this point, the sheet 3 is pinched by the first relay rollers 47A and the second relay roller 47B, which are pressed onto one another, in the direction of thickness of the sheet 3 (in the front-back direction). The sheet 3 then passes through the nips between the two first sheet discharge rollers 45A and the second sheet discharge roller 45B. The sheet 3 is therefore pinched by the first sheet discharge rollers 45A and the second sheet discharge roller 45B, which are pressed onto one another, in the direction of thickness of the sheet 3 (in the up-down direction). The cylindrical curling of the sheet 3 (bending of the lateral parts 3D) can therefore be reduced to some degree.

As shown in FIG. 2, the sheet discharge rollers 45 are rotated in the forward direction (see the solid-line arrows) in order to discharge the sheet 3 onto the sheet discharge tray 44, and in the reverse direction (see the broken-line arrows) in order to convey the sheet 3 backwards. The CPU (not sown) provided in the main casing 2 controls the rotation of the sheet discharge rollers 45.

As described above, the sheet 3 is supplied from the sheet feeding tray 6 (shown in FIG. 1), conveyed through the sheet feeding path 13 of the sheet feeding unit 4, the image-transfer positions T in the image forming unit 5 and the sheet discharge path 46 of the sheet discharge unit 7, and discharged onto the sheet discharge tray 44. The locus of the sheet 3 so supplied is an inverted S as seen from the left side of the main casing 2 (see the solid-line arrows).

4. Other Structural Features

The laser printer 1 can form images on both sides of a sheet 3 (on the first side 3A and the second side 3B). To achieve this, the main casing 2 incorporates an inverting path 48 that guides the sheet 3 so that images are formed on both sides.

The sheet-inverting path 48 connects that part of the sheet discharge path 46, which lies near the outlet port 39 of the fixing unit 18 (i.e., "branching part X" located downstream the outlet port 39 in the direction of conveying the sheet 3 and upstream the relay rollers 47) to that part of the sheet feeding path 13, which lies near the conveying rollers 11 (i.e., "junction part Y" located upstream of the conveying rollers 11 in the direction of conveying the sheet 3). That is, the sheet-inverting path 48 branches from the sheet discharge path 46 and joins, at the junction part Y, to the sheet feeding path 13

The sheet-inverting path 48 is smoothly curved first downward and then backward, from the branching part X. Below the sheet feeding tray 6, the sheet-inverting path 48 extends backward for some distance in an almost horizontal direction. The path 46 is then gently curved upwards and finally connected to the junction part Y.

In the sheet-inverting path 48, pairs of sheet-inverting rollers 52 are arranged. The rollers 52 of each pair are opposed to each other.

To form images on both sides of the sheet 3, the sheet-inverting path 48 guides the sheet 3 having an image formed on only one side (i.e., first side 3A) as described before. (How the path 48 guides the sheet 3 will be explained later in detail.)

<Detailed Description of Fixing Unit>

The flapper 49 of the fixing unit 18 will be described with reference to FIGS. 8-10.

1. Configuration of Flapper

Figure 8:
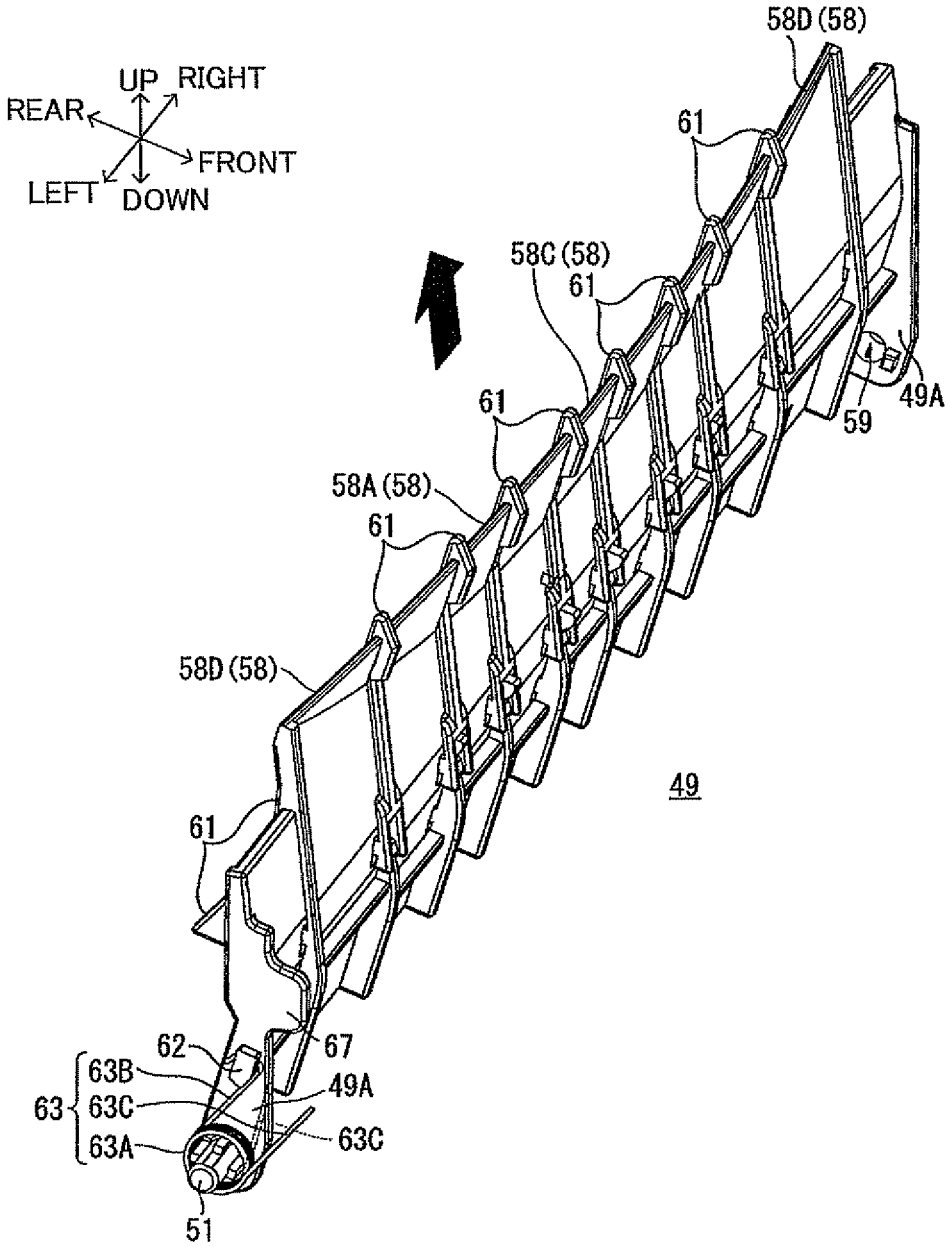
FIG. 8 is a perspective view of a flapper seen from the front left side of the printer.

As shown in FIG. 8, the flapper 49 is a plate elongated in the widthwise direction of the laser printer 1. The flapper 49 appears extending almost vertically, as viewed in the widthwise direction of the laser printer 1 (see FIG. 1 and also FIG. 2).

As shown in FIG. 2, the back surface 58 of the flapper 49 is divided into an upper region 58A and lower region 58B along the sheet conveying direction (up-and-down direction).

Figure 10:
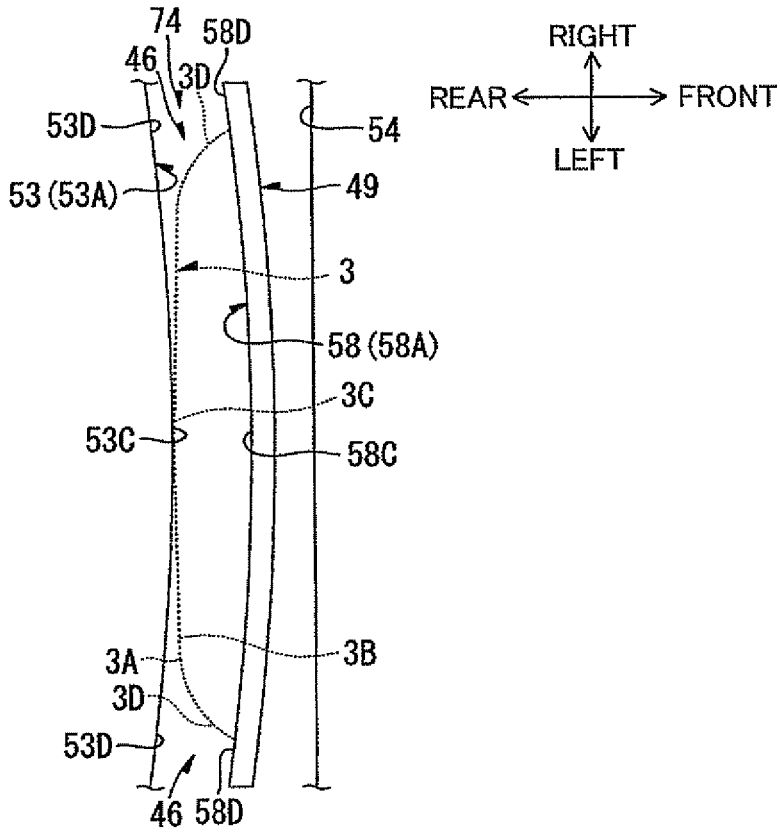
FIG. 10 schematically shows a cross section of a flapper taken along a line A-A in FIG. 2, where the flapper is at the first position.

As shown in FIG. 10, the back 58 of the flapper 49 is divided into a center part 58C and two end parts 59D along a direction orthogonal to the sheet conveying direction.

The upper region 58A of the flapper 49 is forwardly concaved, from the end parts 58D toward the center part 58C. More specifically, the upper region 58A of the flapper 49 looks U-shaped, curved from the end parts 58D toward the center part 58C, as viewed in the sheet conveying direction (that is, in the direction orthogonal to the plane of the drawing of FIG. 10), or the direction of the solid-line arrow in FIG. 8).

As shown in FIG. 2, the lower region 58B is continuous from the lower edge of the upper region 58A (thus lying upstream in the sheet conveying direction). Like the upper region 58A, the lower region 58B may be concaved, as viewed in the sheet conveying direction (see FIG. 10).

At least the lower region 58B of the back 58 is gently curved forwardly from the upstream (lower) side to downstream (upper) side with respect to the sheet conveying direction, as viewed in the widthwise direction of the printer 1. Thus, the lower region 58B can extend, almost along those parts of the sheet discharge path 46 and sheet-inverting path 48, which lie at the branching part X (more precisely, along the inner wall 53 and the outer wall 54).

Note that the back 58 of the flapper 49, per se. need not be so curved. In this example, as shown in FIG. 8, a plurality of ribs 61, which are spaced at intervals in the widthwise direction of the printer 1, are provided on the back 58 to constitute the curved part of the flapper 49. The ribs 61 are shown also in FIG. 12, which will be described later for a second embodiment.

The flapper 49 may be curved as a whole, in the same way the back 58 is curved, as viewed in the widthwise direction of the printer 1.

As FIG. 2 shows, of the front wall of the fixing casing 37 of the fixing unit 18, a part that lies above the outlet port 39 constitutes a part of the inner wall 53 (hereinafter called "inner branching part 53A"), which lies at the branching part X. As shown in FIG. 10, the inner branching part 53A is forwardly protruded, from the end parts 53D in the width direction to the center part 53C, in the width direction. More specifically, the inner branching part 53A is smoothly arched forwardly, from the end parts 53D to the center part 53C, as viewed in the sheet conveying direction (the direction orthogonal to the plane of the drawing in FIG. 10, or the direction of the solid-line arrow in FIG. 8).

As shown in FIG. 2, the flapper 49 is arranged in the sheet discharge path 46, near to and downstream of the outlet port 39 of the fixing unit 18 in the sheet conveying direction. Hence, the flapper 49 overlaps, at least in part, the fixing unit 18 (more precisely, fixing casing 37) as viewed in the direction Z (see the solid-broken-line arrow) of conveying the sheet 3 at the nip position N of the fixing unit 18.

In this state, the back 58 of the flapper 49 is exposed to the branching part X in the sheet discharge path 46. The back 58 therefore faces the inner wall 53 (more correctly, the inner branching part 53A) from the front of the inner wall 53. At this point, in the widthwise direction of the printer 1 (see FIG. 10), the end parts 53D of the inner branching part 53A are almost aligned with the end parts 58D of the back 58 of the flapper 49, and the center part 53C of the inner branching part 53A are almost aligned with the center part 58C of the back 58 of the flapper 49.

As shown in FIG. 8, the flapper 49 has a lower end part 49A. From the left wall of the lower end part 49A, a shaft 51 projects to the left. Above the shaft 51, an engagement member 62 is provided, which has a hook-shaped distal end that extends upwardly. A projection 67 is integrally formed with the left wall of the lower end part 49A and located above the engagement member 62. The projection 67 protrudes forwards.

The right wall of the lower end part 49A has a through hole 59 that is axially aligned with the shaft 51 as viewed in the widthwise direction of the printer 1.

Figure 9:
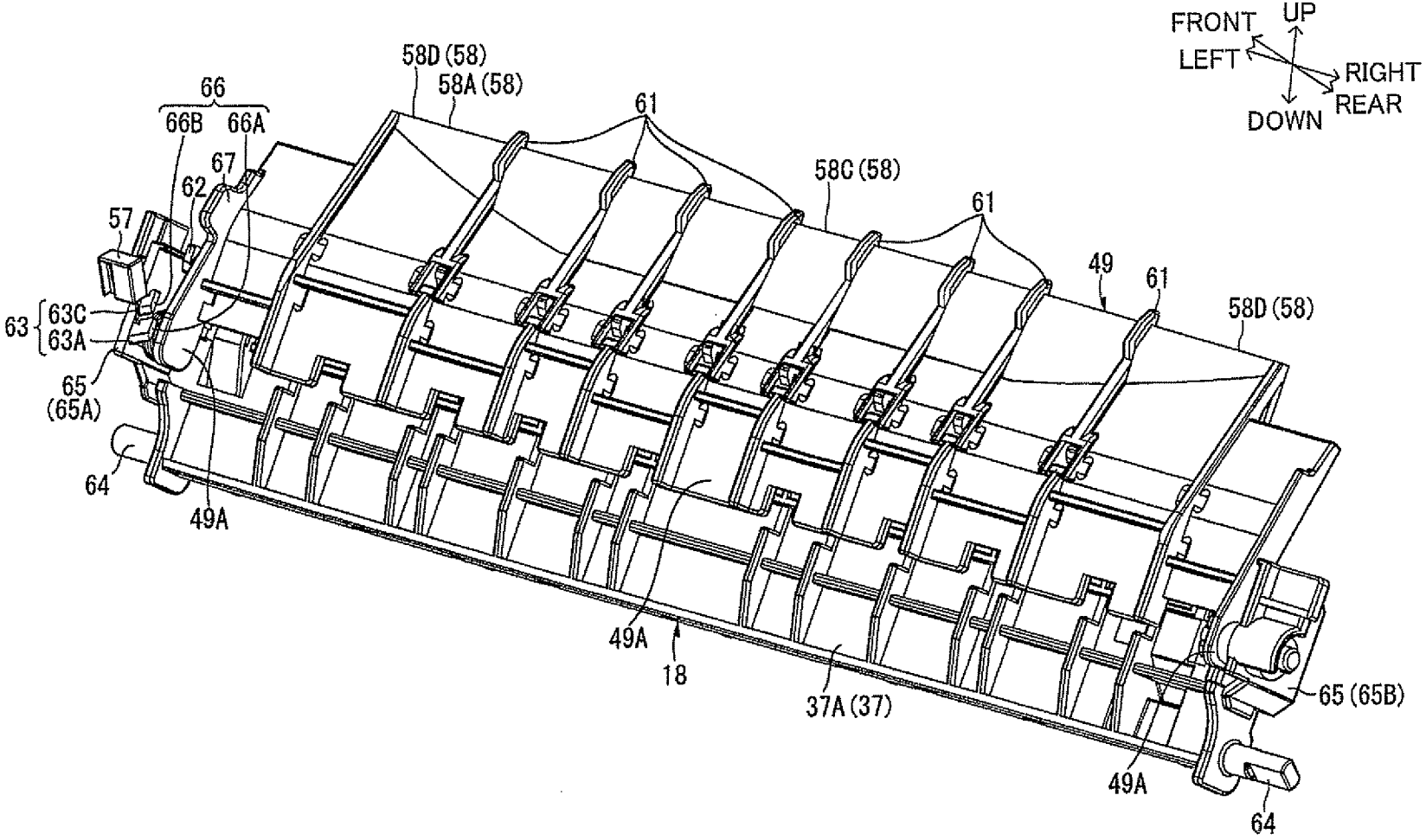
FIG. 9 is a perspective view of an essential part of a fixing unit attached with the flapper, seen from the front right side of the printer.

The flapper 49 configured as described above is supported by the fixing casing 37 of the fixing unit 18 as shown in FIG. 9. FIG. 9 shows not only the flapper 49, but also the lower part (hereinafter called "front-wall lower part 37A"), of the front wall of the fixing casing 37, which lies below the outlet port 39 made in the front wall (see FIG. 2, too).

The front-wall lower part 37A is a plate a little broader than the flapper 49 and can be removed from the fixing casing 37. Two shafts 64 project from the left and right sides of the lower end part of the front-wall lower part 37A. The shafts 64 are inserted in the holes made in the parts of the fixing casing 37, other than the front-wall lower part 37A. The shafts 64 are inserted in, for example, the left and right walls of the fixing casing 37. The front-wall lower part 37A can therefore rotate around the shafts 64. In normal state, however, the front-wall lower part 37A remains being fixed to the fixing casing 37 (see FIG. 2).

Two plates 65 are formed integral with the left and right end parts of the front-wall lower part 37A, respectively, and project forwardly toward the front of the main casing 2. The plates 65 are almost rectangular as viewed in the widthwise direction of the printer 1. The left-side plate 65A has a through hole (not shown), and a shaft (not shown) protrudes from the right-side plate 65B to the left. Two hooks 66 are formed integral with the front edge of the left-side plate 65A. Each hook 66 projects from the right-side plate 65B, and is bent. That is, each hook 66 extends first to the right and then upwards. The distal end of each hook 66 extends upwards. The two hooks 66 are arranged one above the other, along the front edge of the plate 65A. The lower hook 66 shall be called "first hook 66A" and the upper hook 66 shall be called "second hook 66B."

The shaft 51 of the flapper 49 (see FIG. 8) is inserted, from the left, into the through hole (not shown) made in the left-side plate 65A of the front-wall lower part 37A. Similarly, the shaft (not shown) projecting from the right-side plate 65B of the front-wall lower part 37A is inserted, from the right, into the through hole 59 of the flapper 49 (see FIG. 8). The flapper 49 is therefore supported by the front-wall lower part 37A (i.e., fixing casing 37). So supported, the flapper 49 can swing around the lower end part 49A where the shaft 51 and the through hole 59 are provided.

To be more specific, the flapper 49 can swing between a first position (see FIG. 4) and a second position (see FIG. 3) when a solenoid (not shown) is de-energized. When the solenoid (not shown) is energized, however, the flapper 49 is forcibly positioned at the first position (see FIG. 4). Thus, by energizing the solenoid, the above-mentioned CPU (not shown) forcibly positions the flapper 49 at the first position (see FIG. 4). By de-energizing the solenoid, the above-mentioned CPU (not shown) enables the flapper 49 to swing between the first position (see FIG. 4) and the second position (see FIG. 3).

When the flapper 49 is at the first position (FIG. 4), as indicated by the broken line in FIG. 2, the back 58 of the flapper 49 is almost in flush with the outer wall 54 and scarcely project into the sheet discharge path 46. In this position, the flapper 49 blocks the sheet-inverting path 48, at the branching part X. Thus, the flapper 49 disconnects the sheet discharge path 46 from the sheet-inverting path 48, and opens the outlet port 39 of the fixing casing 37, connecting the upstream part 46A and downstream part 46B of the sheet discharge path 46, which lie upstream and downstream the branching part X, respectively.

The second position (FIG. 3) is indicated by the solid line in FIG. 2, and is on the lower-rear side of the first position, that is, on the upstream side of the first position in the sheet conveying direction.

As long as the flapper 49 stays at the second position, the flapper 49 protrudes into the sheet discharge path 46. In this state, the upper region 58A of the back 58 of the flapper 49 contacts the inner wall 53 (more precisely, inner branching part 53A), from the front of the main casing 2. More specifically, of the upper region 58A, at least both end parts 58D (see FIG. 10) abut on the inner wall 53. As a result, the flapper 49 closes, at the branching part X, the sheet discharge path 46 (more precisely, outlet port 39 of the fixing casing 37). That is, the flapper 49 disconnects the upstream part 46A and downstream part 46B of the sheet discharge path 46 from each other. On the other hand, the flapper 49 opens the sheet-inverting path 48 to the downstream part 46B of the sheet discharge path 46. That is, the sheet-inverting path 48 is connected to the downstream part 46B. At this point, the lower region 58B of the back 58 of the flapper 49 is opposed to the inner wall 53, from the front, and spaced apart from the inner wall 53.

As FIG. 8 shows, a spring 63 is wound around the shaft 51 projecting from the left wall of the lower end part 49A of the flapper 49.

The spring 63 is composed of a wound part 63A and two arm parts (i.e., first arm part 63B and second arm part 63C) integrally formed with the wound part 63A. The wound part 63A consists of at least one turn of spring wire. The arm parts project from the ends of the wound part 63, respectively, each extending tangentially from the wound part 63A. The wound part 63A is mounted on the shaft 51 from the left of the shaft 51. One of the two arm parts (first arm part 63B, in this embodiment) engages with the engagement member 62. As long as only one of the two arm parts (the first arm part 63B in this embodiment) engages with the engagement member 62 and the second arm part 63C engages with nothing else as illustrated in FIG. 8, the first arm part 63B extends in a front-upper direction, and the second arm part 63C extends in front of the first arm part 63B, in the front-upper direction.

As shown in FIG. 9, the second arm part 63C is engaged with the hook 66 (i.e., first hook 66A, in FIG. 9) of the fixing casing 37 (i.e., front-wall lower part 37A), from above and behind this hook 66. As a result, the second arm part 63C, which initially extended in the front-upper direction inclines backwards (see the second arm part 63C indicated by broken lines in FIG. 8). As the second arm part 63C so inclines, the entire spring 63 tends to rotate counterclockwise around the shaft 51 (see FIG. 8). Hence, the spring 63 generates a force (bias force) that may move the first arm part 63B (see FIG. 8) backwards. As shown in FIG. 8, the force biases the flapper 49, which engages with the first arm part 63B, to move backwards (toward the second position, see FIG. 2) In other words, the flapper 49 is biased toward the sheet discharge path 46 so that the upper region 58A of the back 58 may contact the inner wall 53 (more precisely, inner branching part 53A, see FIG. 2, too).

The bias force changes in accordance with how much the second arm part 63C, which initially extended forwards (see the solid line in FIG. 8) is inclined backwards (to assume the position indicated by the broken line in FIG. 8). That is, the more the second arm part 63C inclines, the larger the bias force will be. Conversely, the less the second arm part 63C inclines, the smaller the bias force will be.

As shown in FIG. 9, a tab 57 is secured to the distal end of the second arm part 63C of the spring 63. The tab 57 is exposed toward the user when the user opens the cover 60 (see FIG. 1), to access the interior of the main casing 2. The user may hold the tab 57, thereby to set the second arm part 63C into engagement with one of the two hooks (i.e., first hook 66A and second hook 66B).

If the second arm part 63C is set into engagement with the second hook 66B, the second arm part 63C will incline more than when set into engagement with the first hook 66A that lies below the second hook 66B. Thus, the bias force the spring 63 generates can be changed by setting the second arm part 63C into engagement with either the first hook 66A or the second hook 66B.

2. Operation of Flapper (1) To Form Image on Only One Side of Sheet

How a sheet 3 having a toner image thermally fixed on one side (here, first side 3A shown in FIG. 1) is discharged onto the sheet discharge tray 44 will be explained with reference to FIG. 2.

It is noted the CPU (not shown) normally de-energizes the solenoid, thereby enabling the flapper 49 to swing between the first position (indicated by broken line in FIG. 2) and the second position (indicated by solid line in FIG. 2). The flapper 49 normally stays at the second position (indicated by solid line in FIG. 2) due to the urging force of the spring 63.

After the toner image has been thermally fixed, the sheet 3 is cylindrically curled as described above (see FIG. 5(*a*)). The second arm part 63C of the spring 63 set in engagement with the first hook 66A (lower hook). Therefore, the bias force of the spring 63 is smaller than the bias force generated when the second arm part 63C engages with the second hook 66B (upper hook, see FIG. 9).

First, a leading end (which is downstream in the sheet conveying direction) of the sheet 3 conveyed from the fixing unit 18 to the upstream part 46A of the sheet discharge path 46 enters the nip between the back 58 of the flapper 49 (that is located in the second position indicated by solid line) and the inner wall 53 (more precisely, inner branching part 53A). The leading end of the sheet 3 abuts on the back 58 from the upstream side thereof in the sheet conveying direction (i.e., on the lower-back part). More specifically, the leading end of the sheet 3 first abuts on the lower region 58B of the back 58 of the flapper 49. At this point, the leading end of the sheet 3 is curved to the front, extending along the back surface of the lower region 58B (strictly speaking, the ribs 61 mentioned above). In other words, the sheet 3 is forwardly curled to the first side 3A, starting at the leading end (see FIG. 5(*b*)), so that the first side 3A will face inwardly and the second side 3B will face outwardly. Thereafter, the leading end of the sheet 3 passes by the lower region 58B, reaches the upper region 58A and abuts on the upper region 58A.

At this point, the back 58 of the flapper 49 (more precisely, upper region 58A) is opposed to the sheet 3 from the front, and faces the inner wall 53 (more precisely, the inner branching part 53A) across the sheet 3 from the front. As shown in FIG. 10, the both lateral parts 3D of the sheet 3 are almost aligned with the end parts 58D of the flapper 49, respectively, and with the end parts 53D of the inner wall 53, respectively, in the widthwise direction of the printer 1. A part 3C of the sheet 3, which is a central part in the widthwise direction of the sheet 3, is almost aligned with the center part 58C of the back 58 of the flapper 49 and with the center part 53C of the inner wall 53, in the widthwise direction of the printer 1.

As shown in FIG. 10, the back 58 of the flapper 49 (i.e., upper region 58A) is concaved, gradually leaving the sheet 3, from the end parts 58D toward the center part 58C. The inner branching part 53A projects, gradually approaching the sheet 3 from the end parts 58D toward the center part 53C. The upper region 58A and inner branching part 53A of the flapper 49 are almost parallel to each other, as viewed in the sheet conveying direction (i.e., the direction orthogonal to the plane of the drawing (FIG. 10), or the direction of the solid-line arrow shown in FIG. 8). Thus, the space (gap 74) between the upper region 58A and inner branching part 53A, both existing in the sheet discharge path 46, is U-shaped as seen in the sheet conveying direction.

As shown in FIG. 2, the sheet 3, which abuts on the upper region 58A of the flapper 49 from the upstream side of the flapper 49 with respect to the sheet conveying direction, is continuously conveyed to the downstream side with respect to the sheet conveying direction. The sheet 3 therefore pushes the flapper 49 against the bias force of the spring 63 (see FIG. 9) from the second position (see the flapper 49 indicated by solid line in FIG. 2) to the side downstream of the second position with respect to the sheet conveying direction (i.e., first position where the flapper 49 indicated by broken line in FIG. 2).

Thereafter, the sheet 3 is conveyed downstream, passing through the gap between the flapper 49 (precisely, upper region 58A) and the inner wall 53, while being pressed to the inner wall 53 (i.e., inner branching part 53A) by the upper region 58A of the flapper 49, which is biased by the spring 63 in a direction back to the second position.

At this point, the force of the spring 63 biases the flapper 49 in a direction back to the second position. The flapper 49 is therefore urged to the lateral parts 3D of the sheet 3, which curl toward the outer wall 54 (more precisely, toward the side opposite to the inner wall 53) as shown in FIG. 10. As a result, both end parts 58D of the upper region 58A of the back 58 of the flapper 49 abut on the lateral parts 3D from the front, or from the outer wall 54 side. Since the spring 63 biases the flapper 49 toward the second position, the end parts 58D of the upper region 58A press the lateral parts 3D onto the inner wall 53. The lateral parts 3D are thereby stretched straight. That is, the cylindrical curling of the sheet 3 is eliminated. Those parts of the flapper 49, which contact the lateral parts 3D of the sheet 3, are aligned with the upper region 58A in the sheet conveying direction. (That is, the upper region 58A abuts on both lateral parts 3D. See FIG. 2, too.)

As shown in FIG. 2, the sheet 3 passes through the gap between the flapper 49 and the inner wall 53, reaching the downstream part 46B of the sheet discharge path 46. The sheet 3 is then discharged onto the sheet discharge tray 44, as described above. The moment the sheet 3 comes out of the gap between the flapper 49 and the inner wall 53, the flapper 49 returns back completely to the second position (see the flapper 49 indicated by the solid line).

Figure 6A:
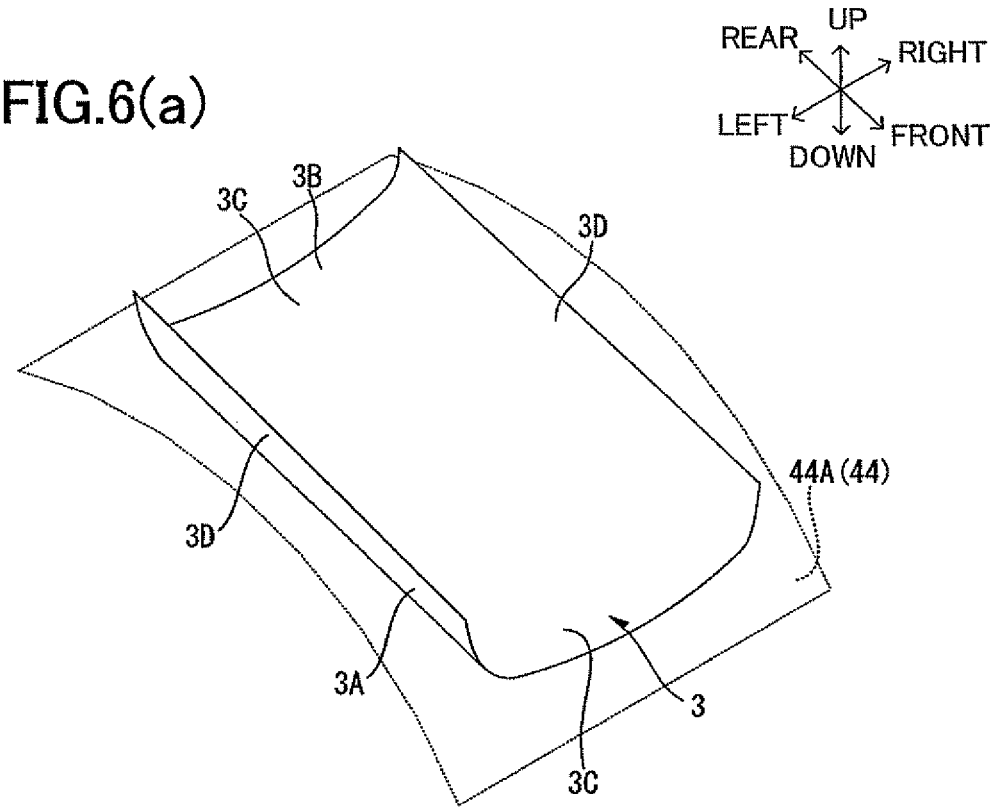
FIG. 6(*a*) is a perspective view showing a cylindrically curled sheet discharged on a discharge tray, seen from a front left side of the printer.
Figure 6B:
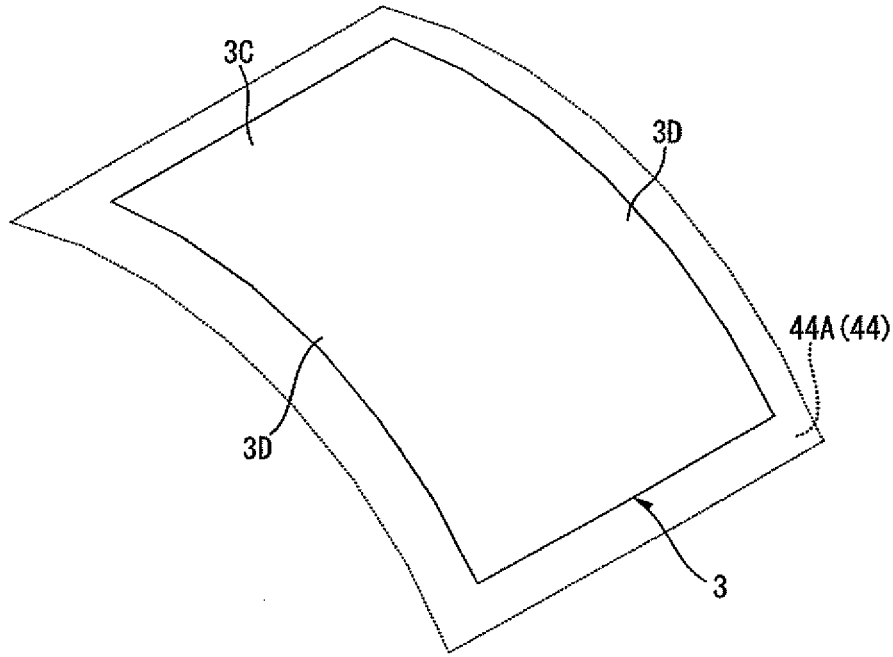

The sheet 3 on the sheet discharge tray 44 may remain cylindrically curled (as shown in FIG. 6(*a*)). In such a case, it is known that the load the flapper 49 exerts on the lateral parts 3D of the sheet 3 is insufficient (see FIG. 10). The user therefore holds the tab 57, thereby to pull the second arm part 63C out of engagement with first hook 66A, i.e., lower hook and sets the second arm part 63C into engagement with the second hook 66B, i.e., upper hook. This increases the bias force of the spring 63, increasing the load the flapper 49 exerts on the lateral parts 3D. That is, the hooks 66 can change the amount of the bias force of the spring 63, ultimately varying the load the flapper 49 exerts on the lateral parts 3D while abutting on the lateral parts 3D. Thus, the load the flapper 49 applies to the lateral parts 3D can be adjusted in accordance with the degree of the curling of the lateral parts 3D (i.e., degree of the cylindrical curling of the sheet 3).

In this embodiment, the flapper 49 can exert two different loads on the lateral parts 3D, one while the second arm part 63C engaging with the first hook 66A, and the other while the second arm part 63C engaging with the second hook 66B. Of course, the flapper 49 can exert three or more different loads on the lateral parts 3D of the sheet 3, or the load can be varied more minutely. For example, three or more hooks 66 may be formed on the front-wall lower part 37A at positions shifted from one another by distances that are shorter than the distance between the above-described hooks 66A and 66B.

The larger the load the flapper 49 exerts, the larger the force the upper region 58A (see FIG. 10) exerts to press the sheet 3 onto the U-shaped inner wall 53 (see FIG. 2), first at the leading end part of the sheet 3 and successively toward the trailing end part of the sheet 3 as the sheet 3 is conveyed in the conveying direction. The sheet 3 can therefore be curled forwards, along the inner wall 53 to the first side 3A.

The sheet 3 undergoes forward curling to the first side 3A when it passes the lower region 58B of the flapper 49, as described above by referring to FIG. 2.

Once discharged onto the sheet discharge tray 44, the sheet 3 thus curled forward is laid on the mounting surface 44A, extending along the surface 44A (see FIG. 6(*b*) and FIG. 7(*b*)).

(2) To Form Image on Both Sides of Sheet

How images may be formed on both sides of the sheet 3 (i.e., first side 3A and second side 3B) will be explained.

Assume that an image has already been formed on the first side 3A of a sheet 3 (that is, a toner image is thermally fixed on the first side 3A). This sheet 3 is conveyed to the sheet discharge rollers 45, passing through the sheet discharge path 46. At this point, the sheet discharge rollers 45 are forwardly rotated (see the solid-line arrow). The rollers 45 therefore convey the sheet 3 toward the sheet discharge tray 44.

When the trailing end of the sheet 3 (i.e., the edge upstream with respect to the sheet conveying direction) passes the branching part X (reaching the downstream part 46B of the sheet discharge path 46), the sheet discharge rollers 45 stop rotating forwards. At this point, the sheet 3 is pinched between the first sheet discharge rollers 45A and the second sheet discharge roller 45B. As described above, while the sheet 3 passes through the gap between the flapper 49 and the inner wall 53 (more precisely, the inner branching part 53A), the flapper 49 is in the first position (see the flapper 49 indicated by the broken line) and the cylindrical curling of the sheet 3 is eliminated. When the sheet 3 finishes passing through the gap between the flapper 49 and the inner wall 53, the flapper 49 completely returns to the second position (see the flapper indicated by the solid line).

After thus stopping, the sheet discharge rollers 45 are rotated in reverse direction (see the broken-line arrow).

As the sheet discharge rollers 45 rotate in the reverse direction, the sheet 3 is conveyed backwards (that is, from the sheet discharge rollers 45 back toward the branching part X). At the branching part X, the sheet 3 is transferred from the downstream part 46B to the sheet-inverting path 48. At this time, with reference to FIG. 1, the first side 3A of the sheet 3 is turned up, and the second side 3B turned down.

In the sheet-inverting path 48, the sheet-inverting rollers 52 convey the sheet 3 backwards for some distance, with the first side 3A turned up.

Thereafter, the sheet 3 is conveyed through the sheet-inverting path 48 to the junction part Y of the sheet feeding path 13. At the junction part Y, the sheet 3 is transferred from the sheet-inverting path 48 to the sheet feeding path 13. The sheet 3 then passes through the sheet feeding path 13. While passing through the path 13, which is U-shaped, the sheet 3 is turned upside down. That is, the first side 3A that was tuned up when the sheet 3 was transferred to the sheet-inverting path 48 is turned down after passing through the sheet feeding path 13. Conversely, the second side 3B that was turned down when the sheet 3 was transferred to the sheet-inverting path 48 is turned up after passing through the sheet feeding path 13.

While passing through the U-shaped part of the sheet feeding path 13, the sheet 3 is sent to the registering rollers 12. The registering rollers 12 adjust the orientation of the sheet 3 turned upside down (the second side 3B turned up). The sheet 3, thus adjusted in orientation, is conveyed to the image forming unit 5. The image forming unit 5 forms an image on the second side 3B of the sheet 3. Thus, images are formed on both sides of the sheet 3.

The sheet 3, now having images on both sides, passes through the gap between the flapper 49 and the inner wall 53, thereby moving the flapper 49 that is now being at the second position (see flapper 49 indicated by the solid line) toward the first position (see flapper 49 indicated by the broken line). The sheet 3 has both lateral parts 3D cylindrically curled to the first side 3A (as indicated by references in the parenthesis ( ) in FIG. 5(*a*)) because the toner image has just been formed on the second side 3B. That is, the sheet 3 is curled at the lateral parts 3D so that the first side 3A will face inwardly and so that the second side 3B will face outwardly. Nonetheless, the cylindrical curling is eliminated while the sheet 3 is passing through the gap between the flapper 49 and the inner wall 53. The sheet 3 is then conveyed through the sheet discharge path 46 to the sheet discharge rollers 45. The sheet discharge rollers 45, which are rotating in the forward direction, discharge the sheet 3 onto the sheet discharge tray 44.

As described above, after an image has been formed on one side (first side 3A) of the sheet 3, the flapper 49 is switched to the second position (indicated by solid line in FIG. 2) and the sheet discharge rollers 45 are switched from forward rotation to the reverse rotation. As a result, the sheet 3 is conveyed though the sheet-inverting path 48 and is turned upside down while passing through the sheet-inverting path 48.

The flapper 49 can swing between the first position (see flapper 49 indicated by the broken line) and the second position (see flapper 49 indicted by the solid line). The flapper 49 therefore guides the sheet 3 into the sheet discharge path 46 (strictly speaking, downstream part 46B) or into the sheet-inverting path 48.

<Advantages of Laser Printer 1 According to First Embodiment>

As FIG. 1 shows, the fixing unit 18 thermally fixes the toner image transferred to a sheet 3 in the laser printer 1 according to this embodiment. The sheet 3 is discharged onto the sheet discharge tray 44. Further, the laser printer 1 has a flapper 49 that is biased toward the sheet discharge path 46 through which the sheet 3 is conveyed from the fixing unit 18 to the sheet discharge tray 44.

The sheet 3 may be curled to the second side 3B at the lateral parts 3D (spaced apart in the widthwise direction orthogonal to the sheet conveying direction) as it undergoes thermal fixing in the fixing unit 18. In this case (that is, the sheet 3 is cylindrically curled as shown in FIG. 5(*a*)), the flapper 49 abuts on the lateral parts 3D from the second side 3B to which the lateral parts 3D are curled (see FIG. 10), eliminating the curling of the lateral parts 3D (i.e., cylindrical curling of the sheet 3).

Biased to the sheet discharge path 46, the flapper 49 can abut on the lateral parts 3D, applying a larger load on the lateral parts 3D than the case where the flapper 49 is not biased. This can efficiently eliminate the cylindrical curling of the sheet 3.

Furthermore, the back 58 of the flapper 49, which faces the sheet 3, is concaved, gradually spaced away from the sheet 3 toward the center part 58C from the end parts 58D in the widthwise direction of the printer 1 as illustrated in FIG. 10. In the widthwise direction of the printer 1, the center part 58C is aligned with the central part 3C of the sheet 3, and the end parts 58D are aligned with the lateral parts 3D of the sheet 3. Thus, when the flapper 49 comes to face the sheet 3, the back 58 of the flapper 49 abuts on the lateral parts 3D of the sheet 3, and the parts of the back 58, other than the end parts 58D, can remain spaced apart from the sheet 3. The flapper 49 can therefore abut on only the lateral parts 3D of the cylindrically curled sheet 3. This can also efficiently eliminate the cylindrical curling of the sheet 3.

Sheets 3, each rendered free of cylindrical curling, can be orderly laid one on another in the sheet discharge tray 44 (see FIG. 6(*b*) and FIG. 7(*b*).

At the wall (i.e., inner wall 53) defining the sheet discharge path 46, the inner branching part 53A that faces the back 58 of the flapper 49 across the sheet 3 (see FIG. 4, too) projects, approaching the sheet 3 from the end parts 53D toward the center part 53C with respect to the widthwise direction of the printer 1. In the widthwise direction of the printer 1, the center part 53C is aligned with the center part 3C of the sheet 3, and the end parts 53D are aligned with the lateral parts 3D of the sheet 3. The end parts 53D of the inner wall 53 (more precisely, the inner branching Part 53A) are aligned with the end parts 58D of the back 58 with respect to the widthwise direction of the printer 1. Further, the center part 53C of the inner wall 53 is aligned with the center part 58C of the back 58, also with respect to the widthwise direction of the printer 1.

Moreover, the gap 74 is formed between the back 58 and inner wall 53, both existing in the sheet discharge path 46. This gap 74 extends or curves from the center part 58C and center part 53C (i.e., center part 3C of the sheet 3) toward the end parts 58D and end parts 53D (i.e., lateral parts 3D of the sheet 3) in a direction opposite to the direction in which the sheet 3 cylindrically curves. The lateral parts 3D curled can therefore be stretched straight while the sheet 3 is passing through the gap 74. Thus, the cylindrical curling of the sheet 2 can be eliminated.

As seen from FIG. 2, the sheet discharge path 46 curves from the upstream side to downstream side in the sheet conveying direction. Therefore, the sheet 3 passing through the sheet discharge path 46 bends gradually from the leading edge (downstream side) in the sheet conveying direction. That is, the sheet 3 gradually undergoes forward curling, as shown in FIG. 5(*b*). The sheet 3, cylindrically curled, is forcedly curled forwards, as the sheet 3 passes through the sheet discharge path 46. Therefore, the cylindrical curling of the sheet 3 can be reliably eliminated.

The flapper 49 is configured so as to be capable of applying the lateral parts 3D of the sheet 3 with a load whose amount is changeable in accordance with a degree by which the lateral parts 3D of the sheet 3 are curled. Because the load the flapper 49 applies to the lateral parts 3D can change in accordance with the degree of the curling at the lateral parts 3D, the cylindrical curling of the sheet 3 can be appropriately eliminated in accordance with the degree of the curling. Furthermore, by properly adjusting the load the flapper 49 applies to the lateral parts 3D, the sheet 3 can be gradually curved (that is, forwardly curled) from the side downstream in the sheet conveying direction. This helps to eliminate the cylindrical curling in a natural manner.

The flapper 49 may swing to abut on both lateral parts 3D of the sheet 3. The flapper 49 can therefore have a simpler structure than configured to slide. Further, the friction loss resulting from the flapper 49 can be smaller than in the case where the flapper 49 is configured to slide.

At least one part of the flapper 49 overlaps the fixing unit 18, as seen in the direction of conveying the sheet 3 (i.e., direction Z in the fixing unit 18). That is, the flapper 49 is arranged near the fixing unit 18. The flapper 49 can therefore abut on both lateral parts 3D of the sheet 3 on which a toner image has just been thermally fixed. The sheet 3 is heated and softened when the toner image is thermally fixed on one side of the sheet 3. Because the flapper 49 abuts on the lateral parts 3D of the sheet 3 immediately after a toner image is thermally fixed on the sheet 3, the cylindrical curling of the sheet 3 can be easily eliminated.

As shown in FIG. 1, the laser printer 1 has a sheet-inverting path 48 that branches from the sheet discharge path 46. The sheet-inverting path 48 turns upside down the sheet 3 whose one side (i.e., first side 3A) has a toner image thermally fixed thereon. A toner image can therefore be thermally fixed on the other side (i.e., second side 3B) of the sheet 3. Thus, images can be formed on both sides of the sheet 3.

The flapper 49 can only abut on both lateral parts 3D of the sheet 3 to eliminate the cylindrical curling of the sheet 3, but also guide the sheet 3 to a selected one of the sheet discharge path 46 and the sheet-inverting path 48. No additional parts designed to guide the sheet 3 to a selected one of the sheet discharge path 46 and the sheet-inverting path 48 need be provided in the printer 1. This helps to reduce the number of components.

The spring 63 (see FIG. 8) biases the flapper 49 toward the lateral parts 3D (see FIG. 10). So biased with the force of the spring 63, the flapper 49 abuts on the lateral parts 3D of the sheet 3, successfully eliminating the cylindrical curling of the sheet 3.

The hooks 66 (see FIG. 9) can change the bias force of the spring 63, varying the load the flapper 49 exerts when abutting on the lateral parts 3D of the sheet 3. Therefore, the flapper 49 can appropriately eliminate the cylindrical curling of the sheet 3 in accordance with the degree of this curling. In addition, the flapper 49 can achieve forward curling on the cylindrically curled sheet 3, thereby eliminating the cylindrical curling.

The back 58 of the flapper 49, which faces the sheet 3, is curved from the upstream side to the downstream side with respect to the sheet conveying direction. The sheet 3 therefore gradually undergoes forward curling, first at the leading edge (downstream end in the sheet conveying direction), as the sheet 3 passes in contact with the back 58. That is, the sheet 3 is forcedly curled forwards, while passing by the back 58 of the flapper 49. Therefore, the cylindrical curling of the sheet 3 can be reliably eliminated.

The mounting surface 44A of the sheet discharge tray 44, on which sheets 3 discharged are stack, is convex upwards from a part upstream to a part downstream, with respect to the sheet conveying direction. Therefore, the sheets 3, each gradually curved upwards (or forwardly curled) from a part upstream to a part downstream, with respect to the sheet conveying direction, can be properly laid on the sheet discharge tray 44 (see FIG. 6(*b*) and FIG. 7(*b*).

In the above description, the CPU (not shown) normally de-energizes the solenoid, thereby enabling the flapper 49 to swing between the first position (indicated by broken line in FIG. 2) and the second position (indicated by solid line in FIG. 2) and to abut on the sheet 3 to eliminate the cylindrical curling of the sheet 3. However, if the sheet 3 undergoes no cylindrical curling, it is unnecessary for the flapper 49 to abut on the sheet 3. In such a case, the CPU (not shown) may energize the solenoid, thereby forcibly positioning the flapper 49 at the first position (indicated by broken line in FIG. 2) when the sheet 3 is conveyed forwards through the branching part X in the sheet conveying direction. When the sheet 3 is conveyed backwards through the branching part X in a direction toward the sheet-inverting path 49, the CPU (not shown) de-energizes the solenoid, thereby allowing the flapper 49 to return to the second position (indicated by solid line in FIG. 2) and properly guiding the sheet 3 into the sheet-inverting path 49.

Second Embodiment

In the first embodiment described above, the bias force of the spring 63, which biases the flapper 49 toward the lateral parts 3D of the sheet 3, is changed in order to vary the load the flapper 49 exerts on the lateral parts 3D of the sheet 3 (see FIG. 9).

Instead, the angle through which the flapper 49 rotates may be changed or regulated, thereby to vary the load the flapper 49 exerts on the lateral parts 3D.

Figure 11:
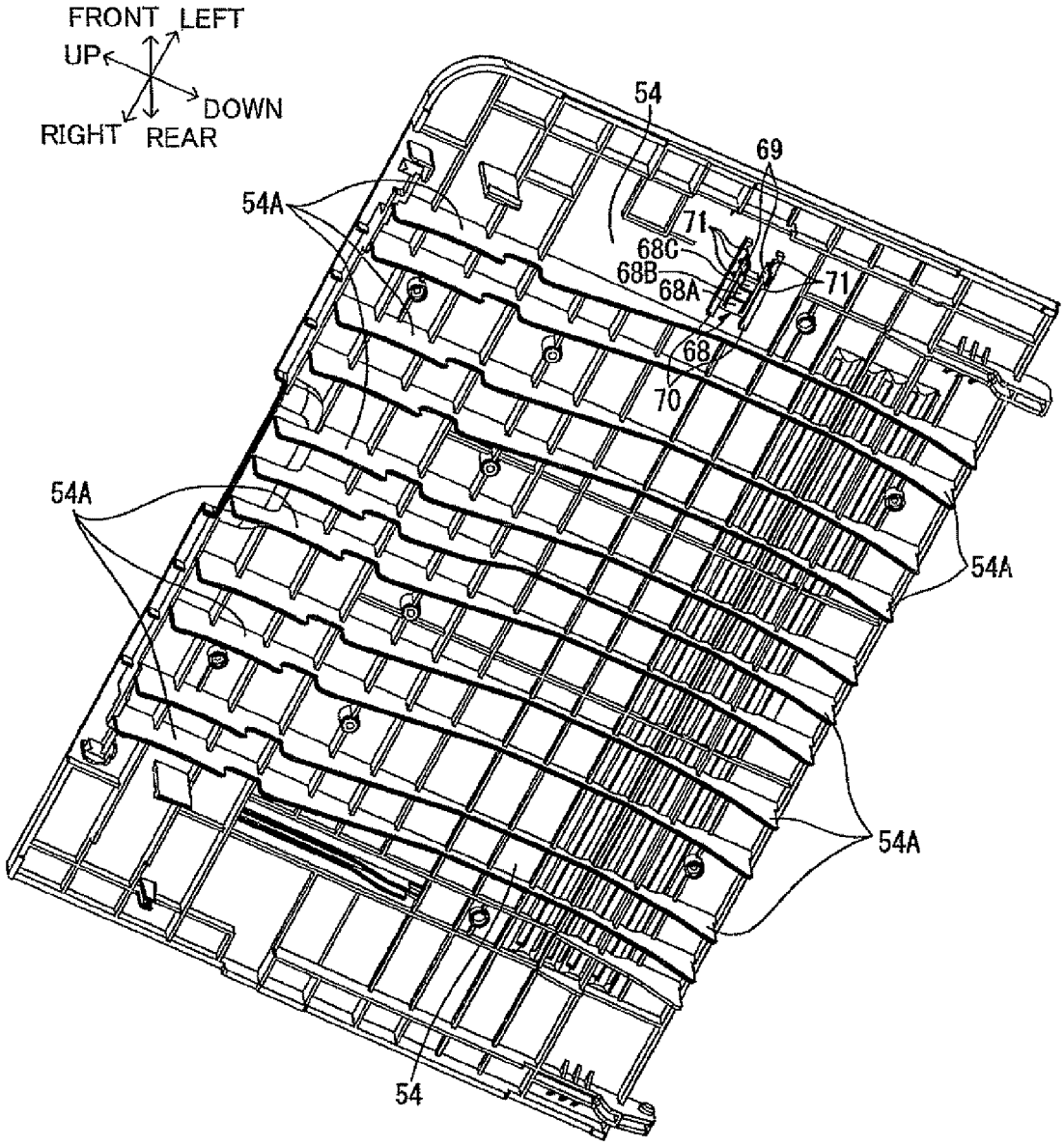
FIG. 11 is a perspective view of a cover seen from the rear left side of a printer according to a second embodiment.
Figure 12:
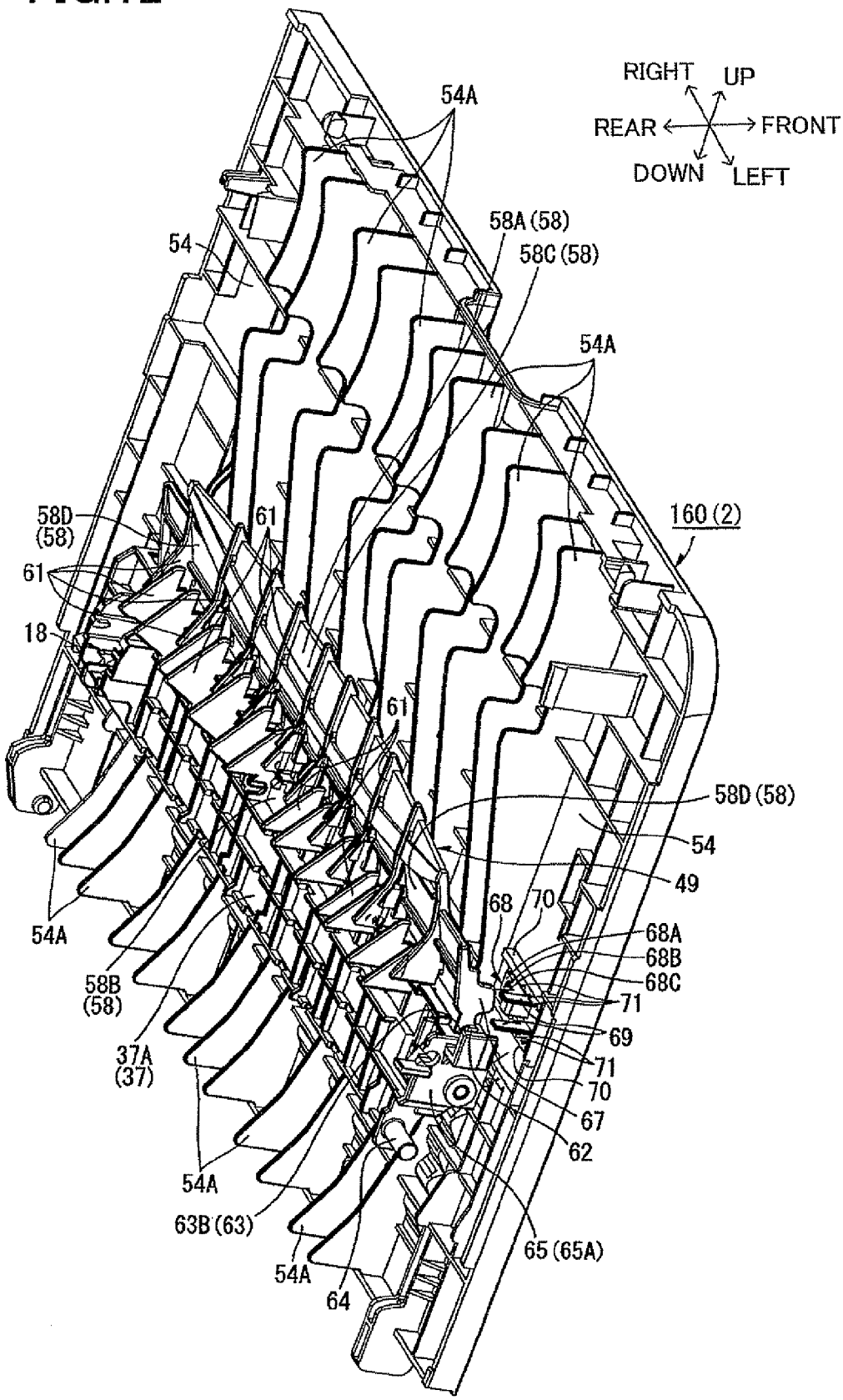
FIG. 12 is a perspective view of the cover and the essential part of the fixing unit attached with the flapper, seen from the rear left side of the printer according to the second embodiment.

A laser printer 100 according to the second embodiment is the same as the laser printer 1 of the first embodiment except that the cover 60 is replaced with a cover 160 shown in FIGS. 11 and 12. The cover 160 is the same as the cover 60 except that the cover 160 has a switching member 68 and a pair of rails 70 as shown in FIG. 11 and FIG. 12. The same components with the first embodiment are referred to with the same reference numerals with the first embodiment.

It is noted that FIG. 12 shows not only the cover 160, but also the front-wall lower part 37A of the fixing casing 37 and the flapper 49. The front-wall lower part 37A of the fixing casing 37 and the flapper 49 have the same configuration in the first embodiment and in the second embodiment.

The switching member 68 is provided on the back of the cover 160 (outer wall 54), as viewed in FIG. 11 and FIG. 12, at a location in the left-side edge in the widthwise direction and almost in the central part in the vertical direction. The switching member 68 is shaped like a block extending in the widthwise direction of the printer 100. The switching member 68 projects stepwise and backwards, toward the left. More specifically, the member 68 is composed of three parts 68A, 68B and 68C, arranged from the right in the order mentioned. Each of the first part 68A, second part 68B and third part 68C has a back surface that is flat in the widthwise direction of the printer 100. The back surface of the second part 68B is positioned on the rear side of the back surface of the first section 68A, and the back surface of the third part 68C is positioned on the rear side of the back surface of the second section 68B.

Two hemispherical projections (not shown) are provided on the upper and lower surfaces of the switching member 68, respectively.

A pair of tabs 69 are formed integral with the switching member 68. The tabs 69 are thin plates and longer in the front-back direction than in the up-down direction. The tabs 69 pinch the left end of the switching member 68 in the up-down direction.

On the back of the cover 160 (i.e., on the outer wall 54), the pair of rails 70 are provided, each projecting backwards, and hold the switching member 68. The rails 70 are spaced apart in the vertical direction, opposed to each other and extend in the widthwise direction of the printer 100. The upper rail 70 has three grooves 71 in the lower surface, which are spaced at regular intervals in the widthwise direction. The lower rail 70 has three grooves 71 in the upper surface (see FIG. 11, too). The three grooves of the lower rail 70 are aligned with the three grooves 71 of the upper rail 70 in the widthwise direction.

The rails 70 hold the switching member 68. The switching member 68 can slide in the widthwise direction if the user holds and moves the tabs 69 to the left or the right. The rightmost position to which the switching member 68 can be positioned is "right-end position," and the leftmost position to which the switching member 68 can be positioned is "left-end position." The midpoint between the left-end position and the left-end position is "center position." In FIG. 12, the switching member 68 lies at the right-end position.

While the switching member 68 remains at the right-end position, the projections (not shown) of the switching member 68 are fitted in the rightmost grooves 71 of the rails 70. While the switching member 68 remains at the center position, the projections (not shown) of the switching member 68 are fitted in the center grooves 71 of the rails 70. While the switching member 68 remains at the left-end position, the projections (not shown) of the switching member 68 are fitted in the leftmost grooves 71 of the rails 70.

To change the position of the switching member 68, the user may pull open the cover 160 toward him or her, exposing the switching member 69 to him or her. The user then holds the tabs 69 to the left-end position, center position or right-end position. Thereafter, the user closes the cover 160. Thus, the distance the flapper 49 can move between the first and second positions can be changed (see FIG. 2).

More specifically, when the cover 160 is closed, the back of the switching member 68 faces the projection 67 of the flapper 49 from the front as shown in FIG. 12. The distance the flapper 49 can move from the second position (indicated by the solid line in FIG. 2) in a direction toward the first position (indicated by the broken line in FIG. 2) changes in accordance with which section of the switching member 68, that is, the first section 68A, second section 68B or third section 58C, faces the projection 67 of the flapper 49.

If the switching member 68 lies at the left-end position, the first section 68A faces the projection 67. The first section 68A is at the foremost position at the back of the switching member 68. Therefore, the projection 67 will not collide with the switching member 68 even if the flapper 49 moves forwards from the second position (indicated by the solid line in FIG. 2) to the first position (indicated by the broken line in FIG. 2). Thus, the flapper 49 can be moved to any position between the first and second positions.

As long as the switching member 68 stays at the center position, the second section 68B remains opposed to the projection 67. The second section 68B is located more backwards than the first section 68A. Therefore, if the flapper 49 is moved for some distance from the second position toward the first position, the projection 67 will collide with the second section 68B, disabling the flapper 49 to move to the first position. In this case, the distance the flapper 49 can move from the second position is shorter than in the case where the first section 68A is opposed to the projection 67 (that is, the switching member 68 lies at the left-end position).

As long as the switching member 68 stays at the right-end position, the third section 68C remains opposed to the projection 67. Since the third section 68C is located more backwards than the second section 68B. Therefore, if the flapper 49 is moved from the second position toward the first position, the projection 67 will soon collide with the third section 68C, and the flapper 49 can scarcely move from the second position. In this case, the distance the flapper 49 can move from the second position is shorter than in the case where the second section 68B is opposed to the projection 67 (that is, the switching member 68 lies at the center position).

As seen from FIG. 2 and FIG. 12, the more the flapper 49 approaches the second position (see the flapper 49 indicated by the solid line), the more strongly the flapper 49 will press the lateral parts 3D of the sheet 3 onto the inner wall 53, increasing the load applied on the lateral parts 3D (see FIG. 10). Thus, as long as the switching member 68 stays at the right-end position, the flapper 49 can scarcely move from the second position. Hence, the load the flapper 49 exerts on the lateral parts 3D is larger than when the switching member 68 stays at the center position or the left-end position.

Conversely, the more the flapper 49 approaches the first position (see the flapper 49 indicated by the broken line), the farther the flapper 49 will move from the inner wall 53. As a result, the more the flapper 49 approaches the first position, the less strongly the flapper 49 will press the lateral parts 3D of the sheet 3 onto the inner wall 53, decreasing the load applied on the lateral parts 3D (see FIG. 10). Thus, as long as the switching member 68 stays at the left-end position, the flapper 49 can move from the second position to the first position. The load the flapper 49 exerts on the lateral parts 3D is therefore smaller than when the switching member 58 stays at the center position or the right-end position.

While the switching member 68 remains at the center position, the distance the flapper 49 can move from the second position is longer than in the case where the switching member 68 remains at the right-end position and is shorter than in the case where the switching member 68 remains at the left-end position. Hence, the load the flapper 49 exerts on the lateral parts 3D while the switching member 68 remains at the center position is smaller than in the case the switching member 68 stays at the right-end position and is larger than in the case the switching member 68 stays at the left-end position.

Thus, the switching member 68 can change the load the flapper 49 applies to the lateral parts 3D of the sheet 3, by changing the distance the flapper 49 can move from the second position.

According to the present embodiment, because the distance the flapper 49 can move from the second position is changed, the spring 63 (see FIG. 8 or FIG. 9) need not be provided to bias the flapper 49 in a direction toward the lateral parts 3D of the sheet, that is, in a direction toward the inner branching part 53A. So, the spring 63 can be dispensed with. Moreover, in this embodiment, a spring or another biasing member may be provided to bias the flapper 49 in a direction away from the lateral parts 3D of the sheet 3 (see FIG. 10), that is, in a direction away from the inner branching part 53A.

Further, instead of changing the distance the flapper 49 can move from the second position as described above, the switching member 68 may be configured so as to hold the flapper 49 at either one of a plurality of (three, for example) prescribed positions relative to the inner wall 53, in order to set the amount of the load the flapper 49 exerts on the lateral parts 3D among a plurality of different amounts. In this case, the switching member 68 can hold the flapper 49: at a position (that is located on the second position side) where the flapper 49 exerts a relatively large load; at another position (that is located on the first position side) where the flapper 49 exerts a relatively small load; and at still another position that is located between the above-mentioned two positions and that enables the flapper 49 to exert load whose amount is between the above-mentioned relatively large load and the above-mentioned relatively small load.

The switching member 68 provided on the cover 160 contained in the main casing 2 thus switches the position of the flapper 49, changing the load the flapper 49 exerts on the lateral parts 3D of the sheet 3 while abutting on the lateral parts 3D. The cylindrical curling of the sheet 3 can therefore be eliminated appropriately in accordance with the degree of the curling. In addition, the cylindrical curled sheet 3 can be curled forward, thereby eliminating the cylindrical curling.

Third Embodiment

A laser printer 200 according to a third embodiment will be described below with reference to FIGS. 1, 2, and 13-17.

The laser printer 200 is the same as the laser printer 1 of the first embodiment except that the inner branching part 53A of the fixing unit 18 is replaced with an inner branching part 253A and the flapper 49 is replaced with a flapper 249. The components the same as those in the first embodiment are referred to with the same reference numerals with the first embodiment.

Similarly to the inner branching part 53A of the first embodiment, the inner branching part 253A is an upper part of the front surface of the fixing casing 37 of the fixing unit 18. The inner branching part 253A is located above the outlet port 39 of the fixing unit 18, and constitutes a part of the inner wall 53.

Figure 13:
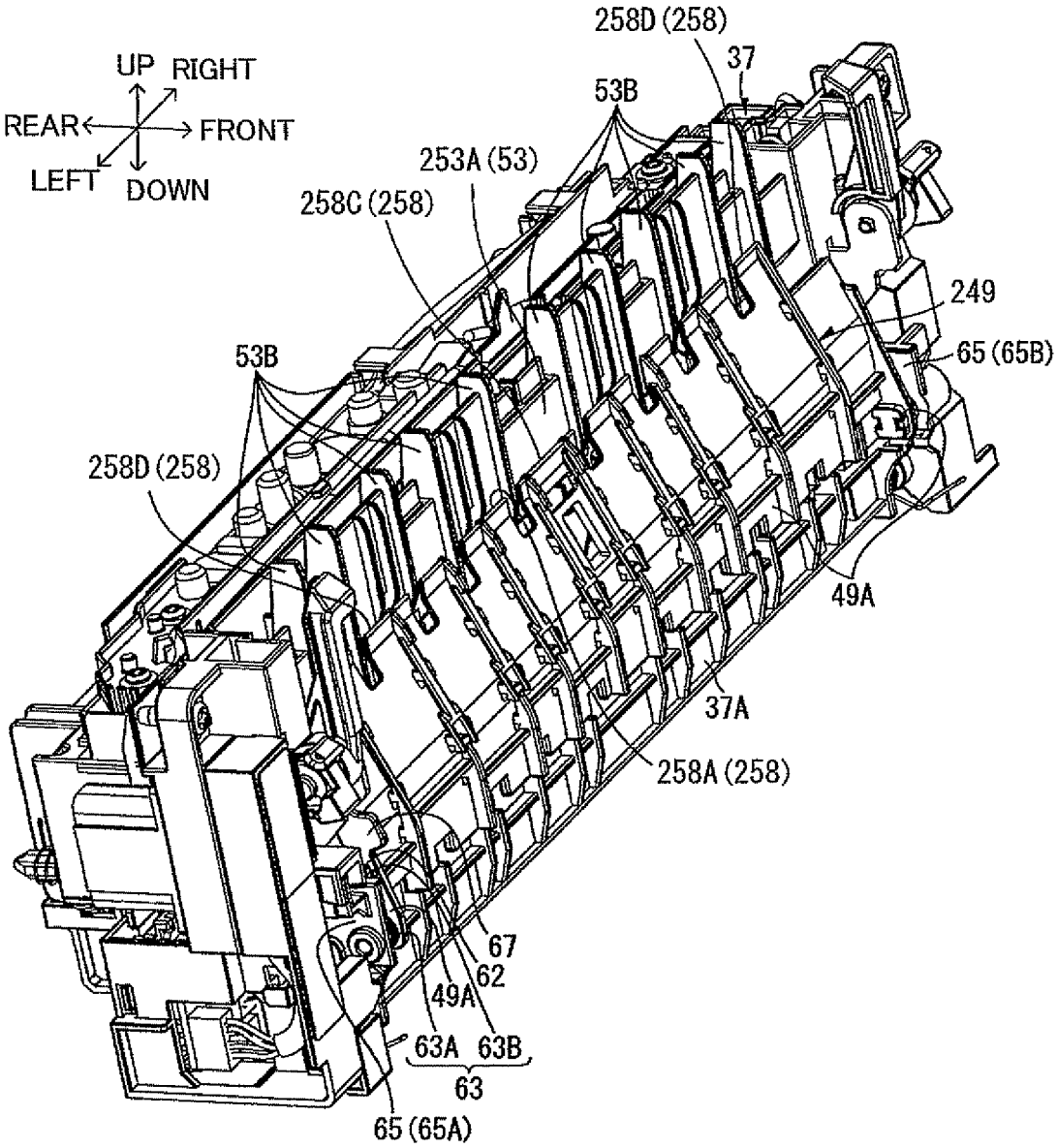
FIG. 13 is a perspective view of a fixing unit seen from the front left side of a printer according to a third embodiment, a flapper being located at the second position.
Figure 14:
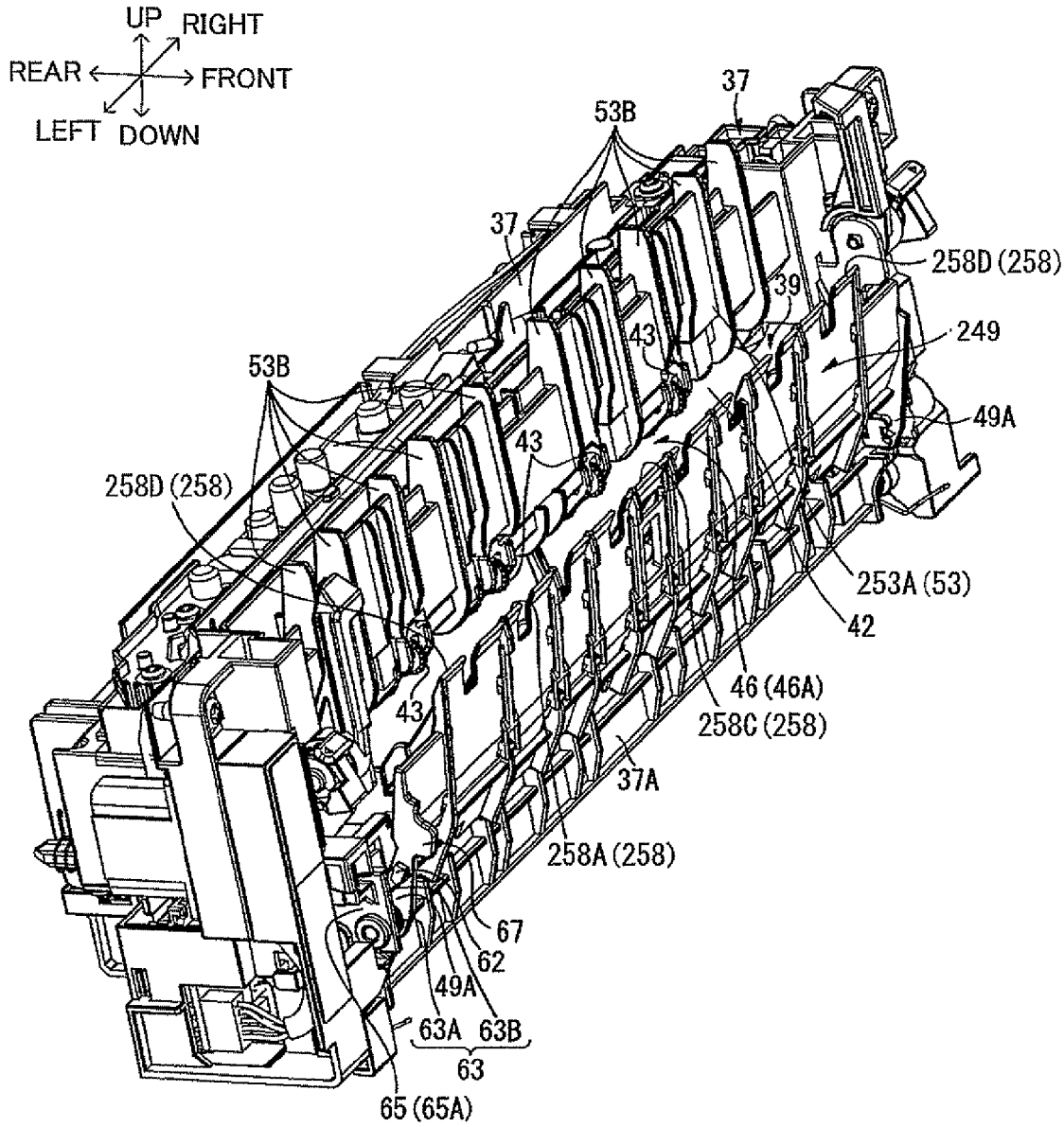
FIG. 14 is a perspective view of the fixing unit seen from the front left side of the printer, the flapper being located at the first position.
Figure 17:
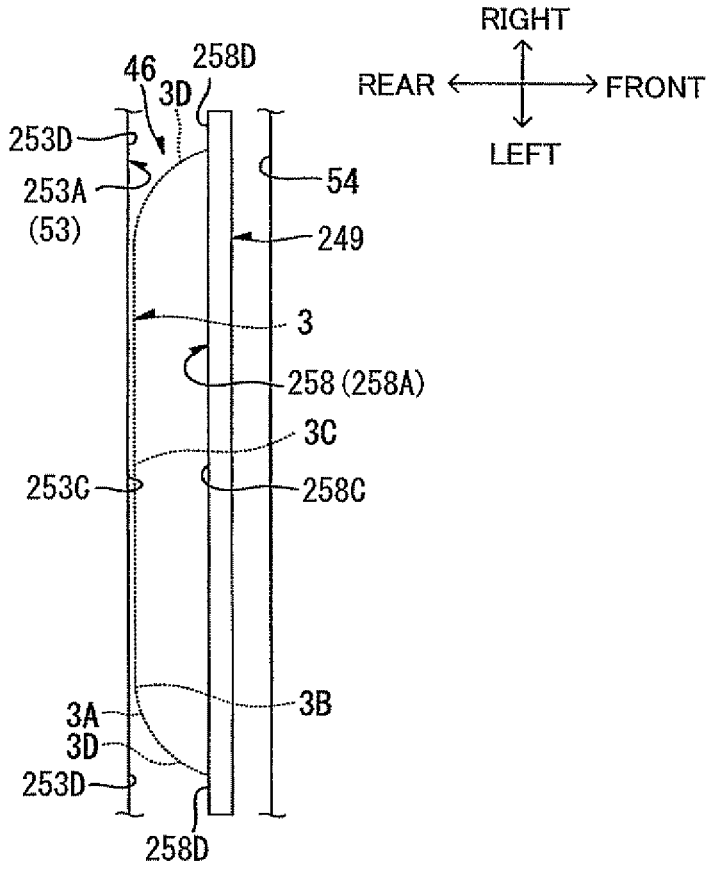
FIG. 17 schematically shows a cross section of the flapper taken along a line A-A in FIG. 2, where the flapper is at the first position.

In the first embodiment, the inner branching part 53A is forwardly protruded from the end parts 53D to the center part 53C in the width directions as described above with reference to FIGS. 3, 4, and 10. Contrarily, according to the present embodiment, as shown in FIGS. 13, 14, and 17, the inner branching part 253A is flat over the entire width thereof as viewed in the sheet conveying direction (that is, in the direction orthogonal to the plane of the drawing of FIG. 17). In other words, according to the third embodiment, the inner branching part 253A is flat over all of its center part 253C and its end parts 253D in the widthwise direction.

Figure 15:
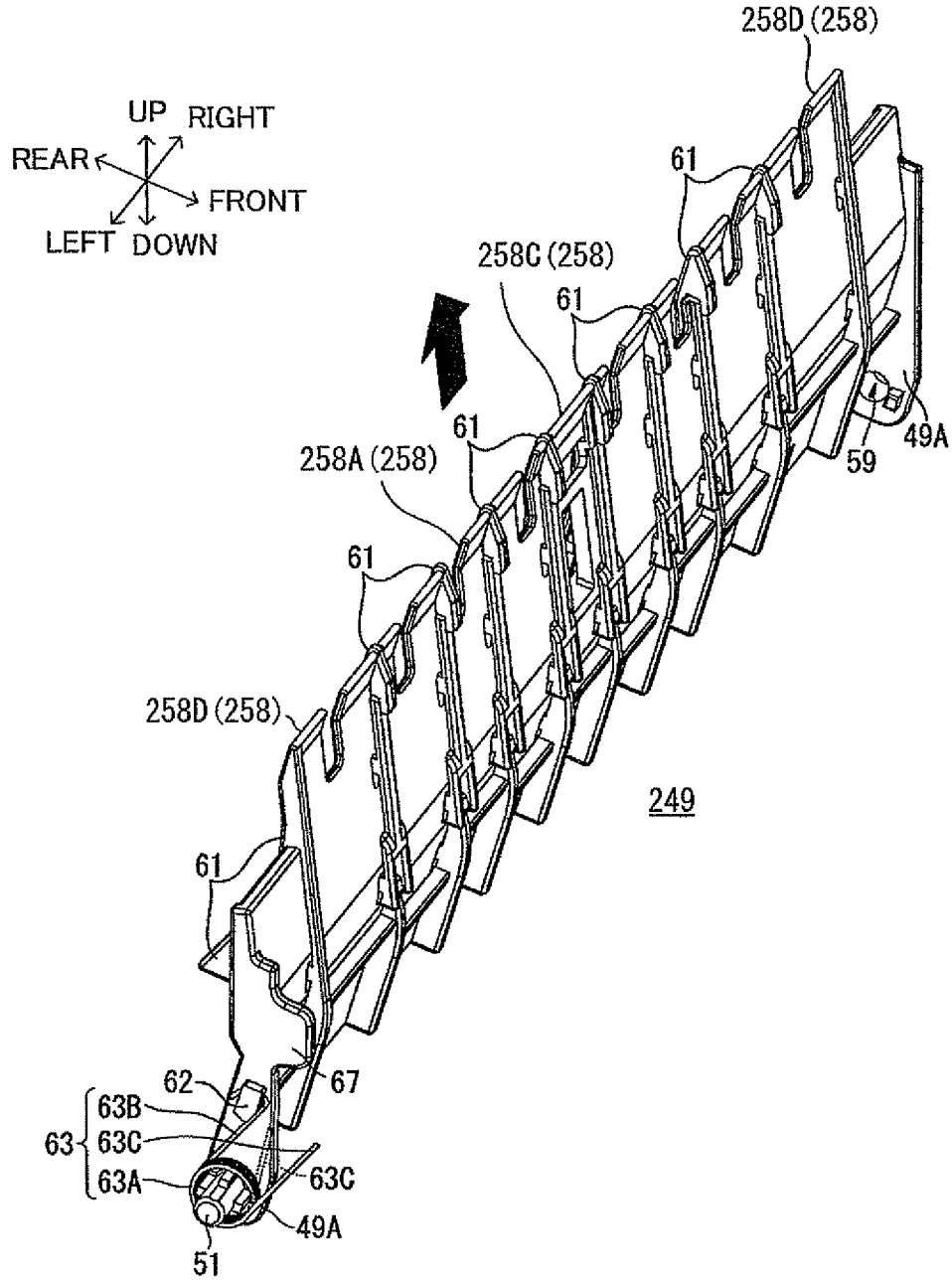
FIG. 15 is a perspective view of the flapper seen from the front left side of the printer.

In the first embodiment, the upper region 58A of the back surface 58 of the flapper 49 is forwardly concaved from the end parts 58D toward the center part 58C as described above with reference to FIGS. 4 and 10. Contrarily, according to the present embodiment, as shown in FIGS. 15 and 17, an upper region 258A of the back surface 258 of the flapper 249 is flat over the entire width thereof as viewed in the sheet conveying direction (that is, in the direction orthogonal to the plane of the drawing of FIG. 17), or the direction of the solid-line arrow in FIG. 15). In other words, according to the third embodiment, the upper region 258A is flat over all of its center part 258C and its end parts 258D in the widthwise direction.

The upper region 258A of the flapper 49 and the inner branching part 253A are almost parallel to each other, as viewed in the sheet conveying direction (i.e., the direction orthogonal to the plane of the drawing of FIG. 17, or the direction of the solid-line arrow shown in FIG. 15.) In the widthwise direction of the printer 200 (see FIG. 17), the end parts 253D of the inner branching part 253A are almost aligned with the end parts 258D of the upper region 258A of the flapper 249, and the center part 253C of the inner branching part 253A are almost aligned with the center part 258C of the upper region 258A of the flapper 249.

It is noted that the lower region 258B of the back surface 258 of the flapper 249, which is continuous from the lower edge of the upper region 258A (thus lying upstream in the sheet conveying direction), may also be flat as viewed in the sheet conveying direction (see FIG. 17), similarly to the upper region 258A.

Except for the above-described points, the laser printer 200 of the present embodiment is the same as the laser printer 1 of the first embodiment.

That is, similarly to the first embodiment, at least the lower region 258B of the back 258 is gently curved forwardly from the upstream (lower) side to downstream (upper) side with respect to the sheet conveying direction, as viewed in the widthwise direction of the printer 200. So, the flapper 249 has the same side sectional shape with the flapper 49 of the first embodiment as shown in FIGS. 1 and 2. In this example, similarly to the first embodiment described above, the back 258 of the flapper 249, per se. is not so curved. Instead, the plurality of ribs 61 are provided on the back surface 258 of the flapper 249 to constitute the curved part of the flapper 249. The ribs 61 are shown also in FIG. 18, which will be described later for a modification of the present embodiment.

Figure 16:
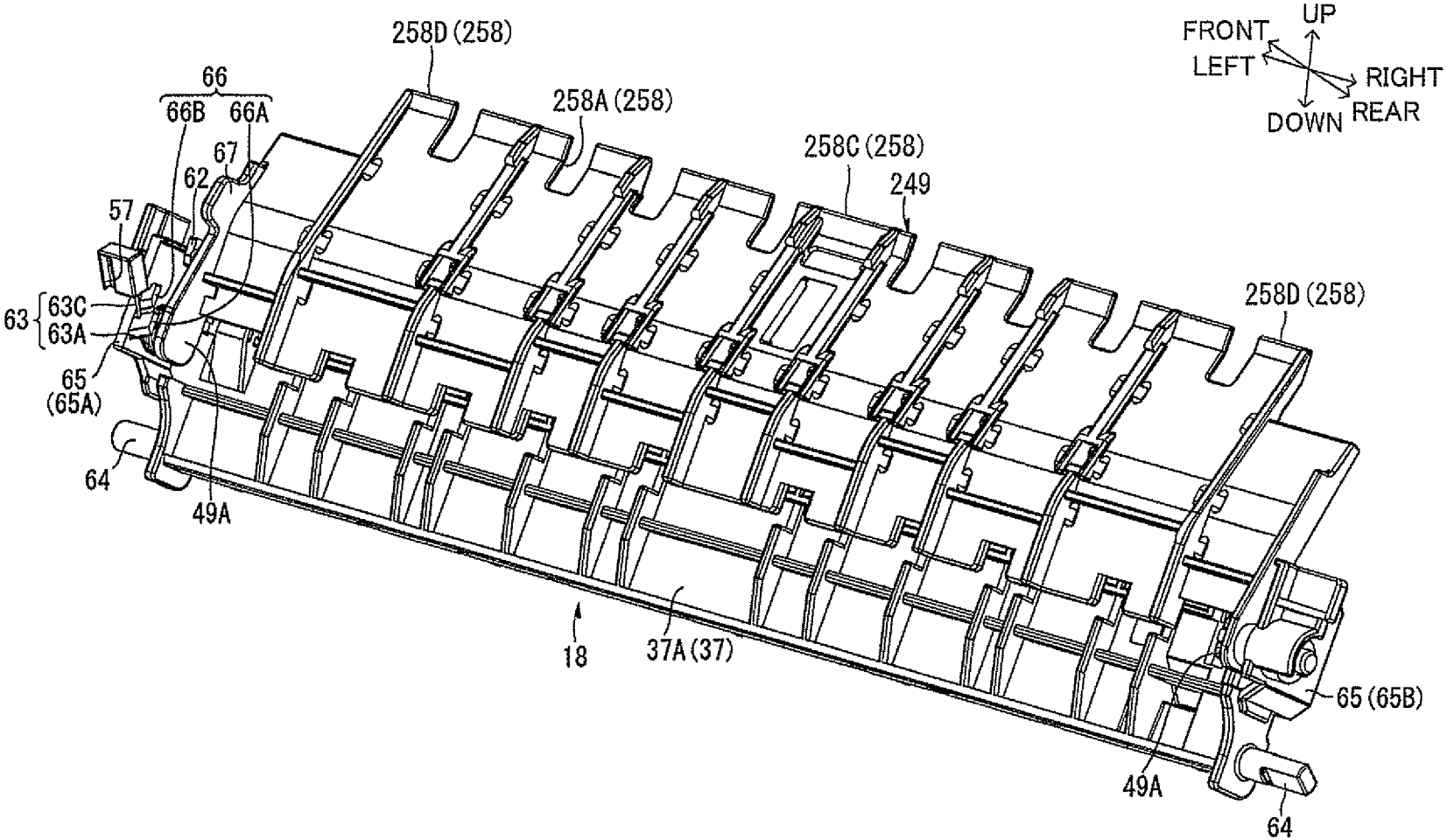
FIG. 16 is a perspective view of an essential part of the fixing unit attached with the flapper, seen from the front right side of the printer.

The flapper 249 shown in FIG. 15 is attached to the front-wall lower part 37A of the fixing casing 37 via the spring 63 as shown in FIG. 16 in the same manner as the flapper 49 in the first embodiment. The flapper 249 can swing between the second position shown in FIG. 13 and indicated by the solid line in FIGS. 1 and 2 and the first position shown in FIGS. 14 and 17 and indicated by the dotted line in FIGS. 1 and 2.

According to the present embodiment, the flapper 249 and the inner wall 53, a part of which is constituted by the inner branching part 253A, cooperate in a manner similar to the flapper 49 and the inner wall 53 in the first embodiment described above. It is noted that similarly to the first embodiment, the plurality of ribs 53B project from the inner wall 53 toward the sheet discharge path 46 and are spaced apart from one another in the widthwise direction of the printer 200 (a part of the ribs 53B is shown in FIGS. 13 and 14).

Similarly to the first embodiment, after a toner image has been thermally fixed by the fixing unit 18, when a leading end of the sheet 3 abuts on the lower region 258B of the back 258 of the flapper 249, the leading end of the sheet 3 is curved to the front, extending along the back surface of the lower region 258B (strictly speaking, the ribs 61 mentioned above). So, the sheet 3 is forwardly curled to the first side 3A, starting at the leading end (see FIG. 5(*b*)). The cylindrical curling of the sheet 3 is eliminated.

When the sheet 3 passes between the upper region 258A of the flapper 249 and the inner branching part 253A, as shown in FIG. 17, the lateral parts 3D of the sheet 3 are almost aligned with the end parts 258D of the flapper 249 and with the end parts 253D of the inner branching part 253A in the widthwise direction of the printer 200. The central part 3C of the sheet 3 is almost aligned with the center part 258C of the back 258 of the flapper 249 and with the center part 253C of the inner branching part 253A in the widthwise direction of the printer 200. The end parts 258D of the upper region 258A of the flapper 249 press the curled lateral parts 3D of the sheet 3 onto the inner branching part 253A. The lateral parts 3D are thereby stretched straight. The cylindrical curling of the sheet 3 is eliminated.

When the bias force of the spring 63 is increased by engaging the spring 63 with the second hook 66B, the load the flapper 249 exerts on the lateral parts 3D is increased. In such a case, the upper region 258A can abut against the entire width of the sheet 3 because the upper region 258A of the flapper 249 is made flat over the entire width thereof. Accordingly, the upper region 258A of the flapper 249 can press the entire width of the sheet 3 with the increased amount of force against the U-shaped inner wall 53 (see FIG. 2), first at the leading end part of the sheet 3 and successively toward the trailing end part of the sheet 3, as the sheet 3 is conveyed in the conveying direction. This ensures that the sheet 3 is curled forwards, along the inner wall 53 to the first side 3A, thereby eliminating the cylindrical curling of the sheet 3.

Figure 18:
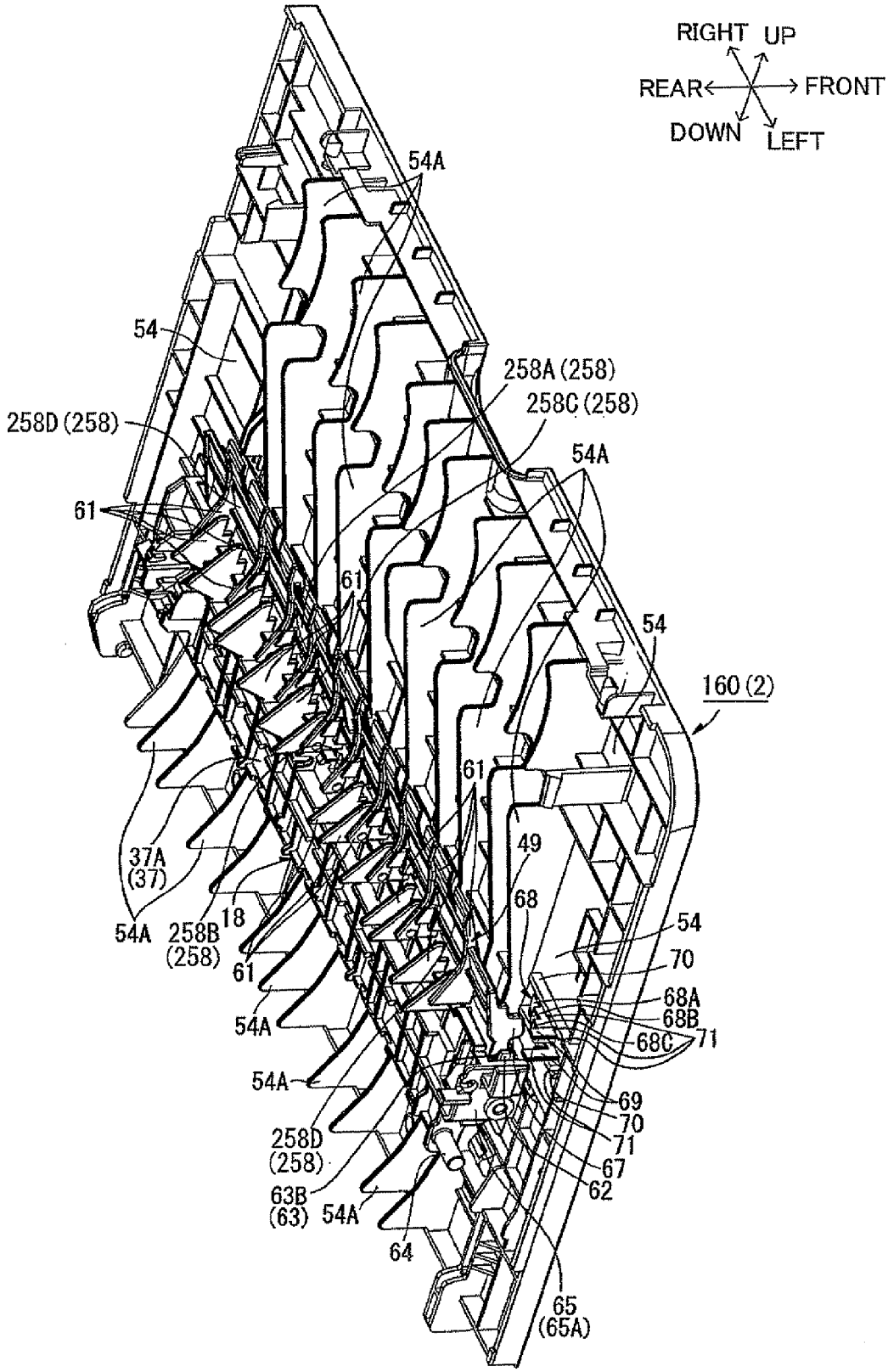
FIG. 18 is a perspective view of the cover and the essential part of the fixing unit attached with the flapper, seen from the rear left side of the printer according to a modification of the third embodiment.

The cover 60 in the printer 200 of this embodiment may be replaced with the cover 160 in the second embodiment as shown in FIG. 18. In this modification, similarly to the second embodiment, the angle through which the flapper 249 rotates can be changed, to vary the load the flapper 249 exerts on the lateral parts 3D.

While the invention has been described in detail with reference to the embodiments thereof, it would be apparent to those skilled in the art that other various changes and modifications may be made therein without departing from the spirit of the invention.

For example, in the embodiments described above, the flapper 49, 249 is configured to swing. Instead, the flapper 49, 249 may be designed to slide.

In the embodiments described above, the flapper 49, 249 is arranged in the sheet discharge path 46, downstream and near the outlet port 39 of the fixing unit 18 (see FIG. 2). Instead, the flapper 49, 249 may be arranged remote from the fixing unit 18, if provided in the sheet discharge path 46.

The embodiments described above are a direct-transfer type color printer, in which toner images are transferred from a plurality of photosensitive drums 27 directly to a sheet 3. This invention is not limited to this type of a printer, nevertheless. The invention can be applied to an intermediate-transfer type color printer, in which toner images are first transferred from the photosensitive drums 27 to an intermediate medium, and then transferred thence to a sheet at a time. The invention can be applied to a monochrome printer, too. In the embodiments, laser beams are applied to the photosensitive drums 27. Nonetheless, the invention can be applied to a laser printer in which the photosensitive drums 27 are exposed to light emitted from LED elements.

In the embodiments, the two hooks 66 (66A and 66B) are formed on the front-wall lower part 37A. However, only one hook 66 may be formed on the front-wall lower part 37A. The bias force the spring 63 generates can be set by engaging the second arm part 63C of the spring 63 into engagement with the single hook 66.

In the second embodiment, the switching member 68 and the pair of rails 70 are provided on the cover 160. However, the switching member 66 and the pair of rails 70 may be provided on another member constituting the housing 2 of the printer 100.

In the second embodiment, the switching member 68 has the three parts 68A, 68B and 68C. However, the switching member 68 may have two or more than three parts, whose back surfaces are positioned differently from one another in the front-to-rear direction. Or, the switching member 68 may have only one part 68A, 68B or 68C. In this case, the switching member 68 can set the load the flapper 49 applies to the lateral parts 3D of the sheet 3, by setting the distance the flapper 49 can move from the second position to a position determined by the single part 68A, 68B or 68C, or by holding the flapper 49 at a position determined by the single part 68A, 68B or 68C.

What is claimed is:

1. An image forming device, comprising:

a fixing unit that thermally fixes a development image transferred onto a first surface of a recording medium, the recording medium having a second surface opposite to the first surface;

a discharging unit that discharges the recording medium onto which the development image has been thermally fixed;

a reception unit that receives the recording medium discharged by the discharging unit;

a conveying wall that defines a conveying path, along which the recording medium is conveyed from the fixing unit toward the discharging unit in a conveying direction, the recording medium being conveyed along the conveying path with the first surface of the recording medium confronting the conveying wall;

a supporting unit; and a flapper that is provided in confrontation with the conveying wall, the flapper being in a plate shape having a pair of lateral parts and a central part arranged in a direction orthogonal to the conveying direction and having a downstream side edge with respect to the conveying direction, the flapper being swingably supported by the supporting unit about an axis extending in the direction orthogonal to the conveying direction such that the downstream side edge serves as a swinging end, the flapper being urged in a direction to move the downstream side edge toward the conveying wall;

the flapper having a concave portion in the plate shape that gradually recedes in a direction away from the conveying wall from the pair of lateral parts toward the central part in the direction orthogonal to the conveying direction.

2. An image forming device as claimed in claim 1, wherein the conveying wall has a projecting portion that opposes the concave portion of the flapper, the conveying wall having a pair of lateral parts and a central part arranged in a direction orthogonal to the conveying direction, the projecting portion gradually projecting in a direction toward the flapper from the pair of lateral parts toward the central part in the direction orthogonal to the conveying direction.

3. An image forming device as claimed in claim 1, wherein the conveying wall has a curved portion that is curved from an upstream side to a downstream side with respect to the conveying direction.

4. An image forming device as claimed in claim 1, further comprising an urging member that is configured to urge the flapper in a direction to move the downstream side edge toward the conveying wall, the urging member applying the flapper with bias force whose amount changes in accordance with a degree by which the flapper is inclined relative to the supporting unit.

5. An image forming device as claimed in claim 1, further comprising:

a bias force adjustment member that is configured to adjust the amount of the bias force of the urging member.

6. An image forming device as claimed in claim 1, wherein the fixing unit has a casing, the supporting unit being provided on the casing, and wherein the flapper is swingably supported by the supporting unit so as to be capable of abutting on the recording medium when the recording medium is conveyed from the fixing unit along the conveying path.

7. An image forming device as claimed in claim 1, wherein at least one part of the flapper overlaps the fixing unit as seen in a direction, in which the recording medium is conveyed in the fixing unit.

8. An image forming device as claimed in claim 1, further comprising an inverting path that branches from the conveying path and that is configured so as to be capable of turning the recording medium whose first surface has a development image thermally fixed thereon, thereby enabling the fixing unit to thermally fix a development image on the second surface of the recording medium, the flapper being configured to guide the recording medium to a selected one of the conveying path and the inverting path.

9. An image forming device as claimed in claim 1, further comprising:

a housing that has a cover member; and a position adjustment member that is provided on the cover member and that is configured to adjust an inclined position of the flapper relative to the supporting unit.

10. An image forming device as claimed in claim 1, wherein the flapper has a curved portion that opposes the conveying wall and that is curved from an upstream side to a downstream side with respect to the conveying direction.

11. An image forming device as claimed in claim 1, wherein the reception unit includes a mounting surface, which is configured to receive the discharged recording medium stacked thereon, the mounting surface having an upstream end and a part downstream from the upstream end in a discharging direction, in which the discharging unit discharges the recording medium, the mounting surface having a convex part that convexes upwardly from the upstream end to the part downstream from the upstream end in the discharging direction.

* * * * *